US009857088B2

(12) United States Patent
Yamashita et al.

(10) Patent No.: US 9,857,088 B2
(45) Date of Patent: Jan. 2, 2018

(54) AIR-CONDITIONING APPARATUS

(71) Applicant: Mitsubishi Electric Corporation, Tokyo (JP)

(72) Inventors: Koji Yamashita, Tokyo (JP); Katsuhiro Ishimura, Tokyo (JP); Takeshi Hatomura, Tokyo (JP); Soshi Ikeda, Tokyo (JP); Shinichi Wakamoto, Tokyo (JP); Naofumi Takenaka, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 285 days.

(21) Appl. No.: 14/648,394

(22) PCT Filed: Feb. 18, 2014

(86) PCT No.: PCT/JP2014/053807
§ 371 (c)(1),
(2) Date: May 29, 2015

(87) PCT Pub. No.: WO2014/129472
PCT Pub. Date: Aug. 28, 2014

(65) Prior Publication Data

US 2015/0308701 A1 Oct. 29, 2015

(30) Foreign Application Priority Data

Feb. 19, 2013 (WO) ..... PCT/JP2013/053996

(51) Int. Cl.
*F24F 5/00* (2006.01)
*F25B 49/02* (2006.01)
(Continued)

(52) U.S. Cl.
CPC ..... *F24F 5/001* (2013.01); *F25B 9/006* (2013.01); *F25B 13/00* (2013.01); *F25B 47/022* (2013.01);
(Continued)

(58) Field of Classification Search
CPC ..... F25B 9/006; F25B 13/00; F25B 47/022; F25B 49/022; F25B 2313/005;
(Continued)

(56) References Cited

U.S. PATENT DOCUMENTS

2011/0079042 A1* 4/2011 Yamashita ..... C09K 5/045 62/498
2014/0083123 A1* 3/2014 Yamashita ..... F25B 49/02 62/222

FOREIGN PATENT DOCUMENTS

EP 2557377 A1 2/2013
JP H02-110255 A 4/1990
(Continued)

OTHER PUBLICATIONS

Office Action dated Dec. 22, 2015 in the corresponding JP application No. 2015-501466 (with English translation).
(Continued)

*Primary Examiner* — Marc Norman
(74) *Attorney, Agent, or Firm* — Posz Law Group, PLC

(57) ABSTRACT

An air-conditioning apparatus includes a refrigerant circuit formed by connecting pipes, a compressor including a compression chamber and an injection port through which refrigerant is introduced into the compression chamber, a first heat exchanger, a subcooling heat exchanger that includes a first flow passage and a second flow passage and exchanges heat between refrigerant flowing in the first flow passage and refrigerant flowing in the second flow passage to subcool the refrigerant flowing in the first flow passage,
(Continued)

a first expansion device, a second heat exchanger, and an accumulator In addition, a first bypass pipe connects the second flow passage of the subcooling heat exchanger with a segment of the pipes, positioned on a refrigerant inflow side of the accumulator; an expansion device to adjust a flow rate of the refrigerant flowing in the first bypass pipe; a second bypass pipe that connects a segment of the pipes with the injection port, the segment being positioned between the first heat exchanger and the second heat exchanger; and an expansion device to adjust a flow rate of the refrigerant flowing in the second bypass pipe.

16 Claims, 11 Drawing Sheets

(51) Int. Cl.
*F25B 9/00* (2006.01)
*F25B 13/00* (2006.01)
*F25B 47/02* (2006.01)

(52) U.S. Cl.
CPC ..... *F25B 49/022* (2013.01); *F25B 2313/005* (2013.01); *F25B 2313/006* (2013.01); *F25B 2313/0233* (2013.01); *F25B 2313/02741* (2013.01); *F25B 2313/0314* (2013.01); *F25B 2400/13* (2013.01); *F25B 2600/0271* (2013.01); *F25B 2600/2509* (2013.01)

(58) Field of Classification Search
CPC ..... F25B 2313/006; F25B 2313/0233; F25B 2313/02741; F25B 2313/0314; F25B 2400/13; F25B 2600/0271; F25B 2600/2509; F25B 2700/21152; F24F 5/001
See application file for complete search history.

(56) References Cited

FOREIGN PATENT DOCUMENTS

| | | | |
|---|---|---|---|
| JP | H07-004754 | A | 1/1995 |
| JP | 2001-227823 | A | 8/2001 |
| JP | 2001-349622 | A | 12/2001 |
| JP | 2003-279169 | A | 10/2003 |
| JP | 2005-282972 | A | 10/2005 |
| JP | 2007-240025 | A | 9/2007 |
| JP | 2008-157550 | A | 7/2008 |
| JP | 2011-185469 | A | 9/2011 |
| WO | 2007/105511 | A1 | 9/2007 |
| WO | 2009/154149 | A1 | 12/2009 |
| WO | 2013/001572 | A1 | 1/2013 |

OTHER PUBLICATIONS

International Search Report of the International Searching Authority dated May 20, 2014 for the corresponding international application No. PCT/JP2014/053807 (and English translation).
Chinese Office Action dated Jun. 20, 2016 in the corresponding CN application No. 201480009377.1(English translation attached).
Office Action dated Jun. 14, 2016 issued in corresponding AU patent application No. 2014219806.
Australian Office Action dated Dec. 4, 2015 in the corresponding Australian Patent application No. 2014219806.
Extended European Search Report dated Aug. 30, 2016 issued in the corresponding EP application No. 14753483.8.

* cited by examiner

AIR-CONDITIONING APPARATUS

CROSS REFERENCE TO RELATED APPLICATIONS

This application is a U.S. national stage application of International Application No. PCT/JP2014/053807 filed on Feb. 18, 2014, which claims priority to International Application No. PCT/JP2013/053996 filed on Feb. 19, 2013, the disclosures of which are incorporated herein by reference.

TECHNICAL FIELD

The present invention relates to an air-conditioning apparatus applied to, for example, a multi-air-conditioning apparatus for buildings.

BACKGROUND ART

As air-conditioning apparatuses, such as multi-air-conditioning apparatuses for buildings, there has been a circuit for performing liquid injection to a portion between a high-pressure liquid pipe to the compressor of a refrigeration cycle in order to lower a discharge temperature of a compressor or an air-conditioning apparatus which is capable of controlling the discharge temperature to a preset temperature, without depending on an operation state (see, for example, Patent Literature 1).

Furthermore, there has also been an air-conditioning apparatus which is capable of injecting a liquid-state refrigerant (liquid refrigerant) in a high-pressure state in a refrigeration cycle to a suction side of a compressor during a cooling operation and during a heating operation (see, for example, Patent Literature 2).

Furthermore, there has also been an air-conditioning apparatus which includes a subcooling heat exchanger on a refrigerant outflow side of a condenser, controls the flow rate of a refrigerant which is caused to flow to the subcooling heat exchanger, and controls the discharge temperature of a compressor (see, for example, Patent Literature 3).

CITATION LIST

Patent Literature

Patent Literature 1: Japanese Unexamined Patent Application Publication No. 2005-282972 (Page 4, FIG. 1 etc.)

Patent Literature 2: Japanese Unexamined Patent Application Publication No. 02-110255 (Page 3, FIG. 1 etc.)

Patent Literature 3: Japanese Unexamined Patent Application Publication No. 2001-227823 (Page 4, FIG. 1 etc.)

SUMMARY OF INVENTION

Technical Problem

For example, as the air-conditioning apparatus described in Patent Literature 1, only a method for performing injection to the portion between the high-pressure liquid pipe and the compressor is disclosed. Therefore, there has been a problem that, for example, a case where a circulation path of a refrigerant circuit is inversed (switching between cooling and heating) or the like cannot be coped with.

Furthermore, the air-conditioning apparatus described in Patent Literature 2 has a configuration in which check valves are arranged in parallel to an indoor-side expansion device and an outdoor-side expansion device so that suction injection of a liquid refrigerant can be achieved both in a cooling time and a heating time. However, a special indoor unit is necessary to realize such an air-conditioning apparatus. Therefore, a normal indoor unit in which a check valve is not connected in parallel to an expansion device cannot be used, posing a problem that a general-purpose configuration cannot be used.

Furthermore, in the air-conditioning apparatus described in Patent Literature 3, an expansion device attached to the subcooling heat exchanger controls the flow rate of the refrigerant which is caused to flow to the subcooling heat exchanger, and controls the discharge temperature. Therefore, the discharge temperature and the degree of subcooling at the outlet of the condenser cannot be independently controlled to target values. Accordingly, it is impossible to properly control the discharge temperature while maintaining a proper degree of subcooling. For example, in the case where an extension pipe which connects an outdoor unit with an indoor unit is long, when the discharge temperature is controlled to a target value, the degree of subcooling at the outlet of the outdoor unit cannot be controlled to a target value. Therefore, due to pressure loss at the extension pipe, a refrigerant which flows into the indoor unit may be turned into a two-phase state. There has been the following problem. That is, for example, in the case where a multi-type air-conditioning apparatus or the like in which an indoor unit includes an expansion device, when the two-phase state occurs at the refrigerant inflow side of the expansion device, noise may be produced or control may become unstable.

The present invention has been made to solve the above problems, and provides an air-conditioning apparatus which is capable of stably controlling the discharge temperature of a compressor and the degree of subcooling of a refrigerant.

Solution to Problem

An air-conditioning apparatus according to the present invention is an air-conditioning apparatus including a refrigerant circuit formed by connecting, with pipes, a compressor including a compression chamber and an injection port through which refrigerant is introduced into the compression chamber, the compressor being configured to compress refrigerant and discharge the compressed refrigerant, a first heat exchanger that exchanges heat with the refrigerant, a subcooling heat exchanger that includes a first flow passage and a second flow passage and exchanges heat between a portion of the refrigerant flowing in the first flow passage and another portion of the refrigerant flowing in the second flow passage to subcool the portion of refrigerant flowing in the first flow passage, a first expansion device to decompress the refrigerant, a second heat exchanger that exchanges heat with the refrigerant, and an accumulator connected to a suction side of the compressor and configured to store excess refrigerant, so that the refrigerant is circulated through the refrigerant circuit, the air-conditioning apparatus comprising: a first bypass pipe that connects the second flow passage of the subcooling heat exchanger with a segment of the pipes, the segment being positioned on a refrigerant inflow side of the accumulator; a second expansion device that adjusts a flow rate of the refrigerant flowing in the first bypass pipe; a second bypass pipe that connects a segment of the pipes with the injection port, the segment being positioned between the first heat exchanger and the second heat exchanger; and a third expansion device to adjust a flow rate of the refrigerant flowing in the second bypass pipe. By injecting the refrigerant into the compression chamber of the compressor, the discharge temperature of the compressor may be lowered. A safe operation is achieved, irrespective of the operation mode, and the life span can be maintained.

Advantageous Effects of Invention

In an air-conditioning apparatus according to the present invention, for example, during a cooling operation, a refrigerant is subcooled so that a liquid-state refrigerant may be caused to flow into an expansion device even when an extension pipe is long, and a refrigerant may be injected to the compression chamber of the compressor not only during a cooling operation but also during a heating operation. Therefore, the discharge temperature of the compressor is not excessively increased. Accordingly, the compressor can be prevented from being damaged, and a longer life span of the entire apparatus can be attained.

DESCRIPTION OF EMBODIMENTS

Embodiment 1

Embodiments of the present invention will be described with reference to the drawings.

Figure 1:
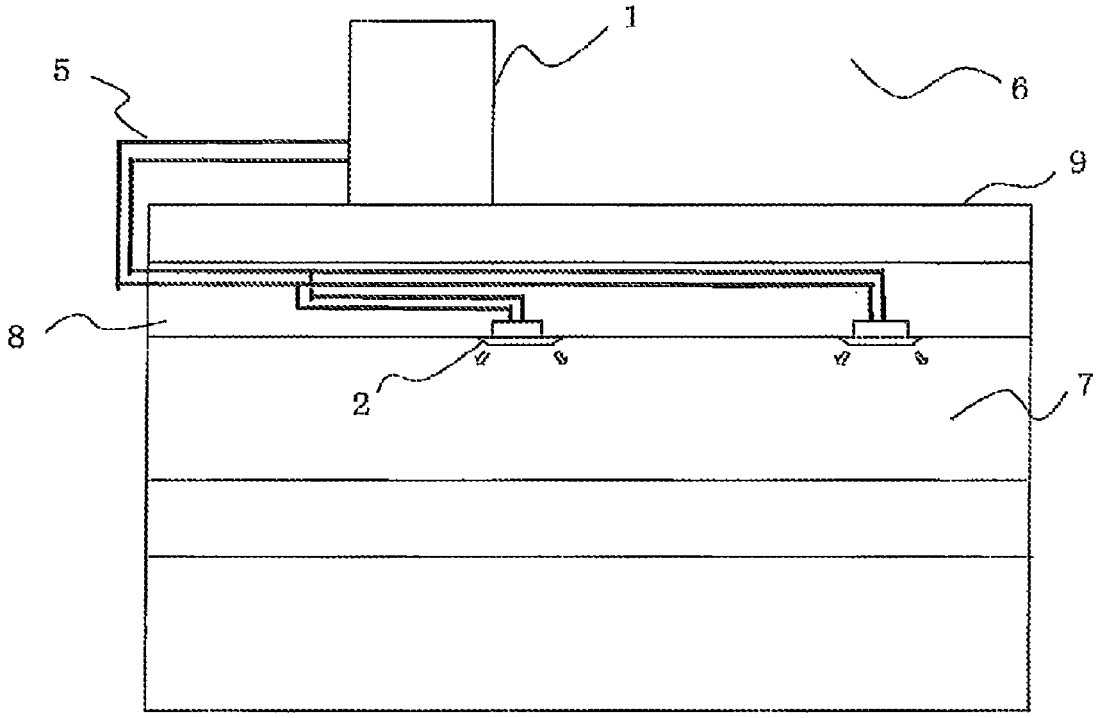
FIG. 1 is a schematic diagram illustrating an example of installation of an air-conditioning apparatus according to Embodiment 1 of the present invention.

FIG. 1 is a schematic diagram illustrating an example of installation of an air-conditioning apparatus according to Embodiment 1 of the present invention. An example of installation of an air-conditioning apparatus will be described with reference to FIG. 1. The air-conditioning apparatus according to Embodiment 1 utilizes heat transfer with a refrigerant by causing the refrigerant to circulate through operation. As an operation mode, a cooling mode for transferring cooling energy or a heating mode for transferring heating energy can be selected. A configuration and the like of the air-conditioning apparatus described in Embodiment 1 illustrate merely an example, and the present invention is not limited to the configuration and the like. In the drawings provided below including FIG. 1, the size relationship of individual component parts may differ from the actual size relationship. Furthermore, in the case where devices, apparatuses, or the like for which subscripts are added to signs are not particularly distinguished from each other or not specified, for example, when common elements are explained, the subscripts may be omitted. In addition, as for expressions of being high and being low in temperature, pressure, or the like, they do not indicate higher or lower values in relation to an absolute value, but they are relatively defined in a state, operation, or the like of a system, an apparatus, or the like.

In FIG. 1, the air-conditioning apparatus according to Embodiment 1 includes one outdoor unit 1 serving as a heat source unit, and a plurality of indoor units 2. The outdoor unit 1 and the indoor units 2 are connected by extension pipes (refrigerant pipes) 5 through which a refrigerant passes, so that the cooling energy or the heating energy generated at the outdoor unit 1 is delivered to the indoor units 2.

Generally, the outdoor unit 1 is arranged in an outdoor space 6, which is a space (for example, a rooftop etc.) outside a structure 9, such as a building, and supplies cooling energy or heating energy to the indoor units 2. The indoor units 2 are arranged at positions from which air whose temperature and the like have been adjusted can be supplied to an indoor space 7, which is a space (for example, a living room etc.) inside the structure 9, and supply cooling air or heating air to the indoor space 7, which is to be an air-conditioned space.

As illustrated in FIG. 1, in the air-conditioning apparatus according to Embodiment 1, the outdoor unit 1 and each of the indoor units 2 are connected by two extension pipes 5.

The case where the indoor units 2 are of a ceiling cassette type is illustrated as an example in FIG. 1. However, the type of the indoor units 2 is not limited to this. The indoor units 2 may be of any type, such as a ceiling-concealed type or a ceiling-suspended type, as long as they are capable of blowing heating air or cooling air to the indoor space 7 directly or via ducts or the like.

Furthermore, the case where the outdoor unit 1 is installed in the outdoor space 6 is illustrated as an example in FIG. 1. However, the outdoor unit 1 is not limited to this. For example, the outdoor unit 1 may be installed in a surrounded space, such as a machine room provided with a ventilating opening. Furthermore, the outdoor unit 1 may be installed inside the structure 9 as long as waste heat can be discharged outside the structure 9 through an exhaust duct or the like. Furthermore, the outdoor unit 1 of a water-cooled type may be installed inside the structure 9. Regardless of where the outdoor unit 1 is installed, no particular problem may occur in the present invention. In the case where an outdoor unit of a water-cooled type is used, a plate-type heat exchanger or the like which exchanges heat between water or brine and a refrigerant is used as a heat-source-side heat exchanger.

Furthermore, the number of the connected outdoor unit 1 and indoor units 2 is not limited to the number of the configuration illustrated in FIG. 1. For example, the number of connected units may be determined in accordance with the structure 9 in which the air-conditioning apparatus according to Embodiment 1 is installed.

Figure 2:
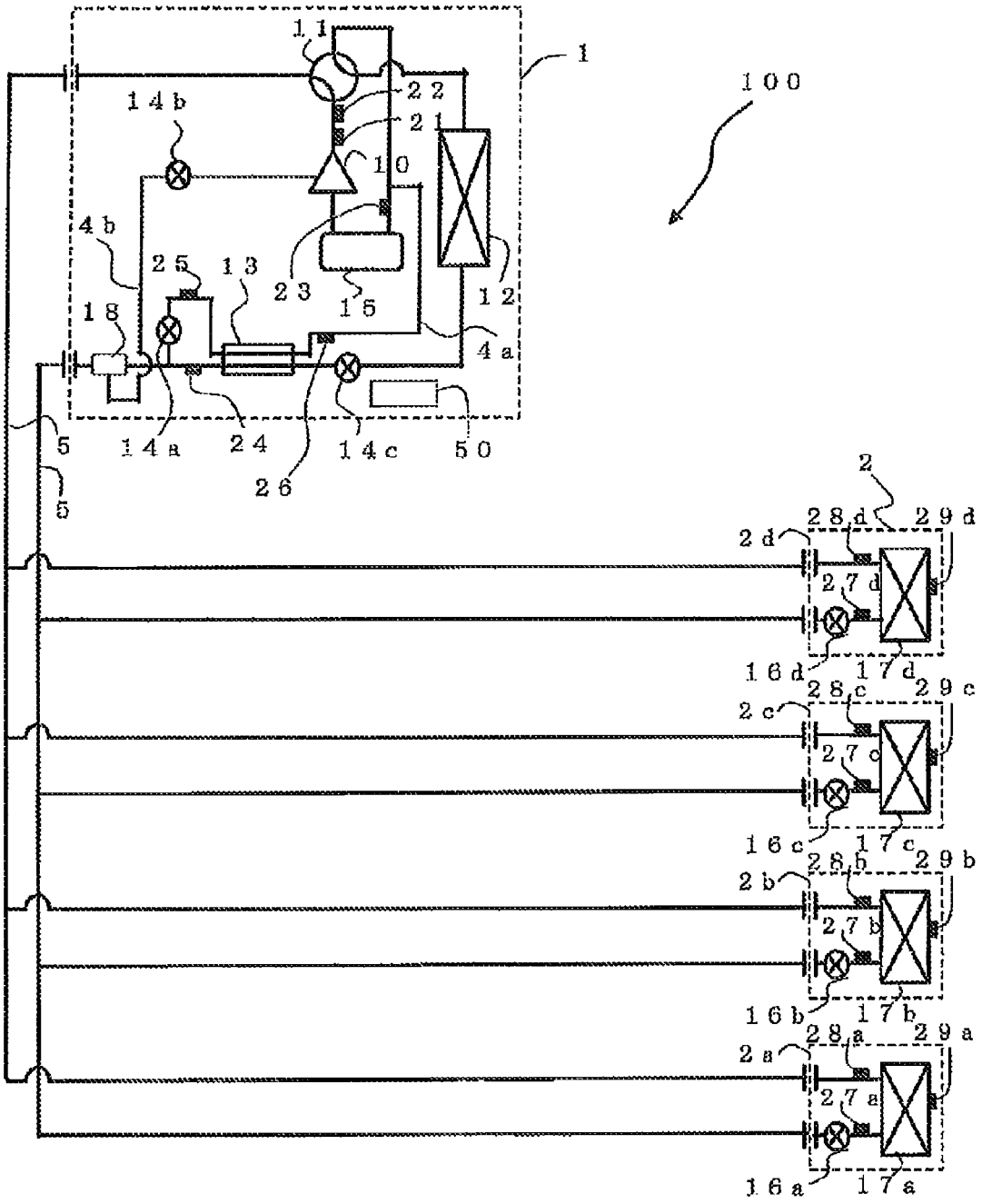
FIG. 2 is a circuit configuration diagram of the air-conditioning apparatus according to Embodiment 1 of the present invention.

FIG. 2 is a schematic diagram illustrating an example of a configuration of an air-conditioning apparatus (hereinafter, referred to as an air-conditioning apparatus 100) according to Embodiment 1. A detailed configuration of the air-conditioning apparatus 100 will be described with reference to FIG. 2. As illustrated in FIG. 2, the outdoor unit 1 and each of the indoor units 2 are connected by the extension pipes 5, as in FIG. 1.

[Outdoor Unit 1]

A compressor 10, a refrigerant flow switching device 11, a heat-source-side heat exchanger 12, and an accumulator 15 which are connected in series by refrigerant pipes are arranged on the outdoor unit 1. Furthermore, the outdoor unit 1 includes a first bypass pipe 4*a*, a second bypass pipe 4*b*, a subcooling heat exchanger 13, expansion devices 14*a*, 14*b*, and 14*c*, and a liquid separator 18.

The compressor 10 sucks refrigerant, compresses the refrigerant into a high-temperature and high-pressure state, and discharges the refrigerant. For example, the compressor 10 may be configured as an inverter compressor or the like for which the capacity can be controlled. The compressor 10 according to Embodiment 1 includes, in a compression chamber for compressing a refrigerant inside the compressor 10, an injection port through which a refrigerant may be introduced from outside of the compressor 10 into the compression chamber. For example, a compressor having a low-pressure shell structure in which a compression chamber is provided in an air-tight container which is under a low-pressure refrigerant pressure atmosphere, and a low-pressure refrigerant within the air-tight container is sucked into the compression chamber and is compressed, is used as the compressor 10. To a side face of the compression chamber, the second bypass pipe 4*b*, which will be described later, is connected, and the injection port through which a refrigerant may be introduced from outside of the compressor 10 into the compression chamber is provided. By injecting, for example, a refrigerant in a two-phase state into the compression chamber of the compressor 10, the discharge temperature of the compressor 10 may be lowered in a case where a refrigerant, such as an R32 refrigerant (hereinafter, referred to as R32), which raises the discharge temperature of the compressor 10, is used. Furthermore, the refrigerant flow switching device 11, such as a four-way valve, switches between the flow of a refrigerant at the time of a heating operation and the flow of a refrigerant at the time of a cooling operation. The heat-source-side heat exchanger 12 serving as a first heat exchanger in the present invention functions as an evaporator during a heating operation, and functions as a condenser during a cooling operation, so that heat exchange is performed between air supplied from an blower device, such as a fan, which is not illustrated in figures, and a refrigerant. The subcooling heat exchanger 13 is a refrigerant-refrigerant heat exchanger which is configured as, for example, a double-tube heat exchanger, includes a first flow passage and a second flow passage, and exchanges heat between the flows of refrigerant flowing in the first and second flow passages. A refrigerant flowing into or flowing out of the heat-source-side heat exchanger 12 passes through the first flow passage. A refrigerant which has passed through the expansion device 14*a* flows into the second flow passage, and flows out to the first bypass pipe 4*a*. The subcooling heat exchanger 13 is not necessarily a double-tube heat exchanger. The subcooling heat exchanger 13 may have any configuration as long as heat exchange between a refrigerant which has passed through the first flow passage and a refrigerant which has passed through the second flow passage is possible. The expansion device 14*a* serving as a second expansion device in the present invention adjusts the pressure and flow rate of a refrigerant which is to pass through the subcooling heat exchanger 13 and the first bypass pipe 4*a*. The expansion device 14*b* serving as a third expansion device in the present invention adjusts the pressure and flow rate of a refrigerant which is to pass through the second bypass pipe 4*b*. The expansion device 14*c* adjusts the pressure and flow rate of a refrigerant. In Embodiment 1, the pressure adjustment of a refrigerant at a pipe between the expansion device 14*a* and an expansion device 16 is performed. The accumulator 15 is provided on the suction side of the compressor 10 and stores excess refrigerant in the refrigerant circuit. The liquid separator 18 separates, for example, part of a liquid refrigerant when a two-phase gas-liquid refrigerant (two-phase refrigerant) passes through the liquid separator 18.

The first bypass pipe 4*a* is a pipe for decompressing, with the operation of the expansion device 14*a*, a refrigerant which has been condensed and liquefied at the condenser and then causing the refrigerant to flow toward the upstream side of the accumulator 15 via the subcooling heat exchanger 13 as a low-pressure superheated gas-state refrigerant (gas refrigerant), for example, during a cooling operation.

During a cooling operation and during a heating operation, the second bypass pipe 4*b* is a pipe for decompressing, with the operation of the expansion device 14*b*, liquid refrigerant at high pressure or first medium pressure and injecting the refrigerant as a two-phase refrigerant at second medium pressure, which is lower than the first medium pressure, into the compression chamber through the injection port provided at the compression chamber of the compressor 10. The high pressure represents the pressure of a refrigerant on the discharge side of the compressor 10. Furthermore, the first medium pressure is lower than the high pressure.

Furthermore, a discharge refrigerant temperature detection device 21, a high-pressure detection device 22, a low-pressure detection device 23, a liquid refrigerant temperature detection device 24, a subcooling heat exchanger inlet refrigerant temperature detection device 25, a subcooling heat exchanger outlet refrigerant temperature detection device 26, and a controller 50 are also provided. The discharge refrigerant temperature detection device 21 is a device which detects the temperature of a refrigerant discharged from the compressor 10. The high-pressure detection device 22 is a device which detects the pressure on the discharge side of the compressor 10, which is the high-pressure side in the refrigerant circuit. The low-pressure detection device 23 is a device which detects the pressure on the refrigerant inflow side of the accumulator 15, which is the low-pressure side in the refrigerant circuit. The liquid refrigerant temperature detection device 24 is a device which detects the temperature of a liquid refrigerant. The subcooling heat exchanger inlet refrigerant temperature detection device 25 is a device which detects the temperature of a refrigerant which flows into the second flow passage of the subcooling heat exchanger 13. The subcooling heat exchanger outlet refrigerant temperature detection device 26 is a device which detects the temperature of a refrigerant which flows out of the second flow passage of the subcooling heat exchanger 13. Furthermore, the controller 50 controls each of the devices in the outdoor unit 1 in accordance with detection information at each detection device, an instruction included in a signal from a remote controller, and the like. For example, control of the frequency of the compressor 10, the rotation speed (including ON/OFF) of the blower device (not illustrated in figures), switching of the refrigerant flow switching device 11, and the like is performed, and each operation mode described below is performed. In Embodiment 1, for example, control of the expansion device 14*b*, the expansion device 14*c*, and the like is performed, and the flow rate, pressure, and the like of a refrigerant to be injected to the suction side of the compressor 10 can be adjusted. A specific control operation will be explained below as an explanation for operation of each operation mode. The controller 50 is configured as a microcomputer or the like.

[Indoor Units 2]

The expansion device 16 and a use-side heat exchanger 17 are arranged in each of the indoor units 2. The expansion devices 16 and the use-side heat exchangers 17 are connected to the outdoor unit 1 by the extension pipes 5. The expansion devices 16, such as, for example, expansion valves or flow control devices, functioning as first expansion devices in the present invention decompress refrigerant passing through the expansion devices 16. Furthermore, the use-side heat exchangers 17 serving as second heat exchangers in the present invention allow heat exchange between air supplied from the blower devices, such as fans, which are not illustrated in figures, and a refrigerant, and generate heating air or cooling air to be supplied to the indoor space 7. Furthermore, although not illustrated in FIG. 2 and the like, each of the indoor units 2 includes a controller which controls the expansion device 16, the blower device, and the like.

The case where four indoor units 2 are connected is illustrated as an example in FIG. 2, and the indoor units 2 are illustrated as an indoor unit 2*a*, an indoor unit 2*b*, an indoor unit 2*c*, and an indoor unit 2*d* in this order from the bottom of the drawing. Similarly, in association with the indoor units 2*a* to 2*d*, the expansion devices 16 are illustrated as an expansion device 16*a*, an expansion device 16*b*, an expansion device 16*c*, and an expansion device 16*d* in this order from the bottom side of the drawing. Furthermore, the use-side heat exchangers 17 are illustrated as a use-side heat exchanger 17*a*, a use-side heat exchanger 17*b*, a use-side heat exchanger 17*c*, and a use-side heat exchanger 17*d* in this order from the bottom side of the drawing. Although the four indoor units 2 are illustrated in FIG. 2, the number of connected indoor units 2 in Embodiment 1 is not necessarily four, as in FIG. 1.

Next, each operation mode executed by the air-conditioning apparatus 100 will be explained. The air-conditioning apparatus 100 according to Embodiment 1 determines, as the operation mode of the outdoor unit 1, one of the cooling operation mode and the heating operation mode, for example, in accordance with an instruction from each of the indoor units 2.

The air-conditioning apparatus 100 performs air-conditioning of the indoor space 7 by causing all the driving indoor units 2 to perform the same operation (cooling operation or heating operation) in accordance with the determined operation mode. In both the cooling operation mode and the heating operation mode, operation and non-operation of each of the indoor units 2 can be performed in a desired manner.

[Cooling Operation Mode]

Figure 3:
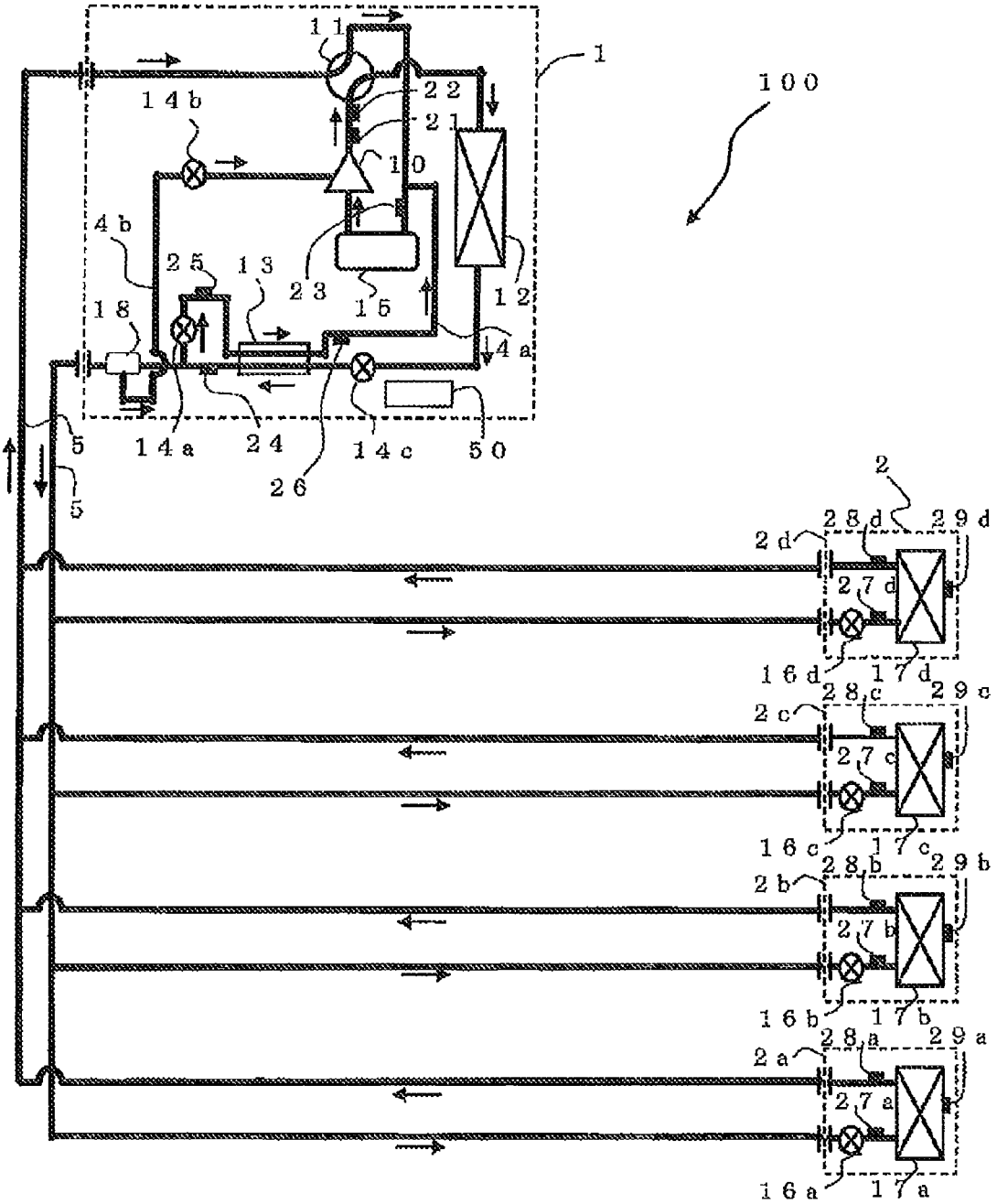
FIG. 3 is a circuit configuration diagram at the time of a cooling operation by the air-conditioning apparatus according to Embodiment 1 of the present invention.

FIG. 3 is a diagram illustrating the flow of refrigerant in the refrigerant circuit in a cooling operation mode of the air-conditioning apparatus 100. In FIG. 3, the cooling operation mode will be explained by way of example of the case where a cooling energy load is generated in all the use-side heat exchangers 17. In FIG. 3, pipes indicated by thick lines represent pipes through which a refrigerant flows, and the direction in which a refrigerant flows is indicated by solid-line arrows.

In the cooling operation mode illustrated in FIG. 3, in the outdoor unit 1, the controller 50 instructs the refrigerant flow switching device 11 to perform switching to a flow passage through which a refrigerant which has been discharged from the compressor 10 flows into the heat-source-side heat exchanger 12. Then, the compressor 10 compresses low-temperature, low-pressure refrigerant and discharges high-temperature, high-pressure gas refrigerant. The high-temperature, high-pressure gas refrigerant which has been discharged from the compressor 10 flows through the refrigerant flow switching device 11 into the heat-source-side heat exchanger 12. Then, the gas refrigerant condenses and liquefies while transferring heat to the outdoor air at the heat-source-side heat exchanger 12, and turns into high-pressure liquid refrigerant. The high-pressure liquid refrigerant which has flowed out of the heat-source-side heat exchanger 12 passes through the fully-opened expansion device 14*c* and the first flow passage of the subcooling heat exchanger 13. The refrigerant which has passed through the first flow passage of the subcooling heat exchanger 13 is split and flows into two flow passages. One of the split flows of the refrigerant passes through the liquid separator 18 and flows out of the outdoor unit 1. The other one of the split flows of the refrigerant flows into the first bypass pipe 4*a*. The high-temperature, high-pressure liquid refrigerant which has flowed into the first bypass pipe 4*a* is decompressed at the expansion device 14*a* into a low-temperature, low-pressure two-phase refrigerant, passes through the second flow passage of the subcooling heat exchanger 13, and merges into a flow passage on the upstream side of the accumulator 15. At this time, at the subcooling heat exchanger 13, heat exchange is performed between the high-temperature, high-pressure liquid refrigerant which has flowed through the first flow passage and the low-temperature, low-pressure two-phase refrigerant which has flowed through the second flow passage. Therefore, the refrigerant which has flowed through the first flow passage is cooled by the refrigerant which has flowed through the second flow passage, and the refrigerant which has flowed through the second flow passage is heated by the refrigerant which has flowed through the first flow passage.

The expansion device 14*a* adjusts the opening degree (opening port area) thereof to adjust the flow rate of refrigerant which is to flow through the first bypass pipe 4*a*. The controller 50 controls the opening degree of the expansion device 14*a* such that the temperature difference (degree of superheat) of the refrigerant at the second flow passage of the subcooling heat exchanger 13, which is the temperature difference between the temperature detected at the subcooling heat exchanger outlet refrigerant temperature detection device 26 and the temperature detected at the subcooling heat exchanger inlet refrigerant temperature detection device 25, becomes closer to a target value. Although control is performed such that the degree of superheat of the refrigerant at the second flow passage of the subcooling heat exchanger 13 becomes closer to a target value in the above case, the opening degree of the expansion device 14*a* may be controlled such that the degree of subcooling of the refrigerant on the downstream side (outflow side) of the first flow passage of the subcooling heat exchanger 13 becomes closer to a target value.

The high-temperature, high-pressure liquid refrigerant which has flowed out of the outdoor unit 1 flows through the extension pipes 5 and flows into the indoor units 2 (2*a* to 2*d*). The high-temperature, high-pressure liquid refrigerant which has flowed into the indoor units 2 (2*a* to 2*d*) is expanded at the expansion devices 16 (16*a* to 16*d*) into a low-temperature, low-pressure two-phase refrigerant, flows into the use-side heat exchangers 17 (17*a* to 17*d*) operating as evaporators, receives heat from air circulating around the use-side heat exchangers 17, and turns into a low-temperature, low-pressure gas refrigerant. Then, the low-temperature, low-pressure gas refrigerant flows out of the indoor units 2 (2*a* to 2*d*), flows through the extension pipes 5 into the outdoor unit 1 again, passes through the refrigerant flow switching device 11, and merges with a refrigerant which has flowed through the first bypass pipe 4*a* and caused to flow toward the upstream side of the accumulator 15. Then, the refrigerant flows into the accumulator 15 and is sucked into the compressor 10 again.

At this time, the opening degree (opening port area) of the expansion devices 16*a* to 16*d* is controlled such that the temperature difference (degree of superheat) between the temperature detected at use-side heat exchanger gas refrigerant temperature detection devices 28 and the temperature detected at use-side heat exchanger liquid refrigerant temperature detection devices 27 becomes closer to a target value.

In Embodiment 1, the subcooling heat exchanger 13 is provided to reliably subcool refrigerant (in a liquid refrigerant state) even if the extension pipes 5 are long (for example, 100 m etc.). With longer extension pipes 5, the pressure loss within the extension pipes 5 increases. Therefore, if the degree of subcooling of a refrigerant is small, the refrigerant may become a two-phase refrigerant before reaching the indoor units 2. Inflowing of a two-phase refrigerant into the indoor units 2 means inflowing of the two-phase refrigerant into the expansion devices 16. Expansion devices, such as expansion valves and flow control devices, have the property of causing noise around the expansion devices when receiving inflow of a two-phase refrigerant. The expansion devices 16 in Embodiment 1 are arranged inside the indoor units 2 which deliver temperature-adjusted air to the indoor space 7. Therefore, the generated noise which is emitted to the indoor space 7 may make a resident feel discomfort. Furthermore, if the two-phase refrigerant flows into the expansion devices 16, the pressure becomes unstable, and the operation of the expansion devices 16 thus becomes unstable. Accordingly, there is a need to cause a refrigerant which has been reliably subcooled into a liquid state to flow into the expansion devices 16. For the above reasons, the subcooling heat exchanger 13 is provided. The expansion device 14*a* is provided at the first bypass pipe 4*a*. By increasing the opening degree (opening port area) of the expansion device 14*a* to increase the flow rate of a low-temperature, low-pressure two-phase refrigerant flowing in the second flow passage of the subcooling heat exchanger 13, the degree of subcooling of the refrigerant which flows out of the first flow passage of the subcooling heat exchanger 13 is increased. Conversely, by decreasing the opening degree (opening port area) of the expansion device 14*a* to decrease the flow rate of a low-temperature, low-pressure two-phase refrigerant flowing in the second flow passage of the subcooling heat exchanger 13, the degree of subcooling of the refrigerant which flows out of the first flow passage of the subcooling heat exchanger 13 is decreased. By adjusting the opening degree (opening port area) of the expansion device 14*a* as described above, the degree of subcooling of the refrigerant at the outlet of the first flow passage of the subcooling heat exchanger 13 may be controlled to an appropriate value. However, in terms of reliability, a state where the compressor 10 sucks a refrigerant with a low quality (degree of dryness) containing a large amount of liquid refrigerant during a normal operation is not desirable. Thus, in Embodiment 1, the first bypass pipe 4*a* is connected to a pipe on the refrigerant inflow side (upstream side) of the accumulator 15. The accumulator 15 is configured to store excess refrigerant. With the first bypass pipe 4*a*, most of the refrigerant which is caused to flow toward the refrigerant inflow side of the accumulator 15 is stored inside the accumulator 15, and a situation in which a large amount of liquid refrigerant returns to the compressor 10 can be prevented.

The basic operation of a refrigerant in the cooling operation mode has been described above. In the case where, a refrigerant, such as, for example, R32, which makes the discharge temperature of the compressor 10 higher than an R410A refrigerant (hereinafter, referred to as R410A), is used, the discharge temperature needs to be lowered in order to prevent degradation of refrigerating machine oil and burnout of the compressor. Thus, after part of a liquid refrigerant split at the liquid separator 18 is decompressed into a two-phase refrigerant, the two-phase refrigerant is caused to flow through the second bypass pipe 4*b* and the injection port provided at the compression chamber of the compressor 10 into the compression chamber of the compressor 10. By causing a refrigerant with a low quality containing a large amount of liquid refrigerant to flow directly into the compression chamber, the temperature of the discharge refrigerant of the compressor 10 can be lowered, and a safe usage can be achieved.

The flow rate of a refrigerant passing through the second bypass pipe 4*b* is adjusted by the opening degree (opening port area) of the expansion device 14*b*. By increasing the opening degree (opening port area) of the expansion device 14*b* to increase the flow rate of the refrigerant flowing through the second bypass pipe 4*b*, the discharge temperature of the compressor 10 is lowered. Conversely, by decreasing the opening degree (opening port area) of the expansion device 14*b* to decrease the flow rate of the refrigerant flowing through the second bypass pipe 4*b*, the discharge temperature of the compressor 10 is increased. By adjusting the opening degree (opening port area) of the expansion device 14*b* as described above, the discharge temperature of the compressor 10 can be made closer to a target value.

Furthermore, in the cooling operation mode, in the case where cooling is performed when the outside air temperature is high, such as the case where a cooling operation is performed in a state where the temperature around the heat-source-side heat exchanger 12 is high, or the like, injection may be performed to the compressor 10 via the second bypass pipe 4*b*.

Figure 4:
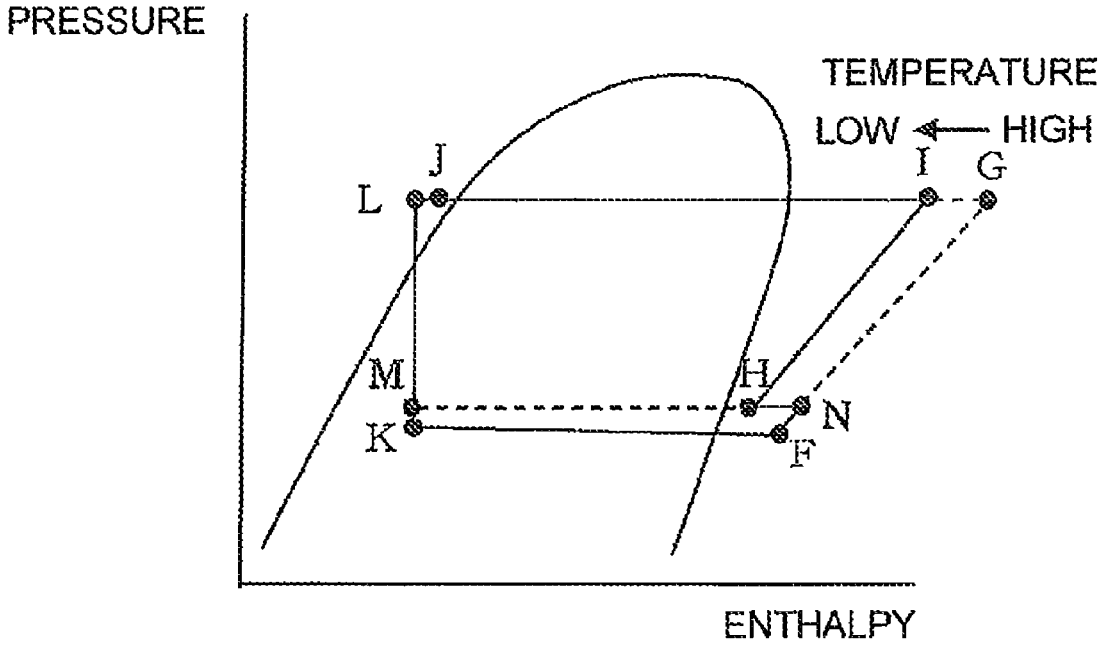
FIG. 4 is a p-h diagram (pressure-enthalpy diagram) at the time of a cooling operation by the air-conditioning apparatus according to Embodiment 1 of the present invention.

FIG. 4 is a p-h diagram (pressure-enthalpy diagram) at the time of a cooling operation by the air-conditioning apparatus according to Embodiment 1 of the present invention. An injection operation will be described in detail with reference to FIG. 4. In the cooling operation mode, a refrigerant which has been compressed at and discharged from the compressor 10 (point I of FIG. 4) is condensed and liquefied at the heat-source-side heat exchanger 12 and turns into a high-pressure liquid refrigerant (point J of FIG. 4). Furthermore, the refrigerant is cooled at the subcooling heat exchanger 13 by the refrigerant which has been split to flow into the first bypass pipe 4*a*, and the degree of subcooling is increased (point L of FIG. 4). Then, the refrigerant flows into the liquid separator 18. Part of the liquid refrigerant split by the liquid separator 18 and caused to flow through the second bypass pipe 4*b* is decompressed into the second medium pressure at the expansion device 14*b* (point M of FIG. 4). Furthermore, the refrigerant is injected through the injection port provided at the compression chamber of the compressor 10 into the compression chamber, and merges with the refrigerant which is sucked into the compressor 10 and compressed into the second medium pressure (point H of FIG. 4). Meanwhile, the high-pressure liquid refrigerant which has passed through the liquid separator 18 flows out of the outdoor unit 1, passes through the expansion pipe 5, flows into the indoor units 2, and is decompressed at the expansion devices 16 (16*a* to 16*d*) of the indoor units 2 (point K of FIG. 4). Furthermore, the refrigerant evaporates at the use-side heat exchangers 17 (17*a* to 17*d*), flows out of the indoor units 2, passes through the expansion pipes 5, and flows into the outdoor unit 1. Then, the refrigerant passes through the refrigerant flow switching device 11, and merges with a refrigerant which has flowed through the first bypass pipe 4*a* and caused to flow toward the upstream side of the accumulator 15. Then, the refrigerant flows into the accumulator 15 (point F of FIG. 4). The refrigerant which has flowed out of the accumulator 15 is sucked into the compressor 10 and compressed into the second medium pressure (point N of FIG. 4) At this time, the refrigerant merges with the refrigerant which has been injected through the second bypass pipe 4*b* (point H of FIG. 4).

In the p-h diagram of FIG. 4 and the like of Embodiment 1, the refrigerant which is obtained after merging the refrigerant which has been compressed into the second medium pressure at the compression chamber of the compressor 10 and the refrigerant which has been injected through the second bypass pipe 4*b* (point H of FIG. 4) is illustrated as if it is a superheated gas refrigerant. However, the position of the point H is determined based on the relationship between the internal energy of the refrigerant which has been compressed into the second medium pressure in the compression chamber (product of the flow rate and enthalpy (point N)) and the internal energy of the refrigerant which has passed through the second bypass pipe 4*b* (product of the flow rate and enthalpy (point M)). When the flow rate of the refrigerant which has passed through the second bypass pipe 4*b* is small, the refrigerant enters a superheated gas state. When the flow rate of the refrigerant which has passed through the second bypass pipe 4*b* is large, the refrigerant enters a two-phase state. In actuality, the position of the injection port at the compression chamber is often determined such that the second medium pressure becomes a value close to low pressure. In this case, only by causing a small amount of refrigerant to flow through the second bypass pipe 4*b*, a two-phase refrigerant is obtained at the point H. In most cases, the second-medium-pressure refrigerant in the two-phase state is compressed in the compression chamber again.

The compressor 10 according to Embodiment 1 is a low-pressure shell-type compressor. The sucked refrigerant and oil flow into a lower part of the compressor 10. Furthermore, a motor is arranged in a middle part of the compressor 10. In an upper part of the compressor 10, a high-temperature, high-pressure refrigerant which has been compressed at the compression chamber is discharged into a discharge chamber inside the air-tight container, and is then discharged from the compressor 10. Thus, the air-tight container, which is made of metal, in the compressor 10 includes a part exposed to a high-temperature, high-pressure refrigerant and a part exposed to a low-temperature, low-pressure refrigerant. Therefore, the temperature of the air-tight container has a medium temperature between the temperatures. Furthermore, electric current flows to the motor, and the motor generates heat accordingly. Therefore, the low-temperature, low-pressure gas refrigerant which has been sucked into the compressor 10 is heated by the air-tight container and the motor of the compressor 10, and the temperature of the refrigerant is thus increased (point F of FIG. 4). Then, the refrigerant is sucked into the compression chamber. The gas refrigerant which has been sucked into the compression chamber is compressed into the second medium pressure (point N of FIG. 4). In the case where refrigerant is injected into the compression chamber of the compressor 10, the temperature of the refrigerant becomes lower (point H of FIG. 4) than the refrigerant which is merged with the injected two-phase refrigerant and cooled and which is not subjected to injection (point N of FIG. 4). Inside the compression chamber, compression continues to be performed, and the refrigerant turns into a high-pressure gas refrigerant. Therefore, the discharge temperature of the compressor 10 in the case where injection is performed becomes lower (point I of FIG. 4) than the discharge temperature of the compressor 10 in the case where injection is not performed (point G of FIG. 4). For example, even in the case where a refrigerant, such as R32, which makes the discharge temperature of the compressor 10 higher than R410A, is used, or the like, by performing injection, the discharge temperature of the compressor 10 can be lowered, and a safe usage can be achieved. Furthermore, a high reliability can be achieved.

Furthermore, it is desirable that the expansion device 14*a* is, for example, an electronic expansion valve or the like whose opening port area is variable. With the use of an electronic expansion valve, the flow rate of refrigerant passing through the second flow passage of the subcooling heat exchanger 13 can be adjusted in a desired manner, and the degree of subcooling of a refrigerant flowing out of the outdoor unit 1 can be finely controlled. However, the expansion device 14*a* is not limited to the above. For example, opening and closing valves, such as small-sized solenoid valves, may be combined together so that the opening degree can be selectively controlled in multiple stages. Furthermore, a configuration in which subcooling may be performed in accordance with the pressure loss of refrigerant by using a capillary tube may be provided. Although the controllability is slightly degraded, the degree of subcooling can be made closer to a target. Meanwhile, the expansion device 14*b* is, for example, an electronic expansion valve or the like whose opening degree is variable. In order to prevent the discharge temperature of the compressor 10 (temperature detected at the discharge refrigerant temperature detection device 21) from being excessively increased, the opening degree of the expansion device 14*b* is adjusted so that the flow rate of the refrigerant may be adjusted. Although the opening degree of the expansion device 14*b* is adjusted directly based on the discharge temperature of the compressor 10 in the above description, the opening degree of the expansion device 14*b* may be adjusted based on a value obtained based on the discharge temperature, such as the degree of discharge superheat.

During execution of a cooling operation mode, there is no need to cause refrigerant to flow to the use-side heat exchanger 17 that has no thermal load (including thermo-off). Therefore, the operation of the indoor unit 2 is stopped. At this time, the opening degree of the expansion device 16 inside the stopped indoor unit 2 is set to be fully closed or small enough for a refrigerant not to flow in the expansion device 16.

As described above, in the cooling operation mode of the air-conditioning apparatus 100 according to Embodiment 1, the two bypass pipes: the first bypass pipe 4*a* and the second bypass pipe 4*b*, are provided. The first bypass pipe 4*a*, through which a refrigerant flows via the subcooling heat exchanger 13 and the expansion device 14*a*, is connected to a flow passage on the upstream side of the accumulator 15, and the second bypass pipe 4*b*, through which refrigerant which is separated at the liquid separator 18 and whose flow rate is adjusted at the expansion device 14*b* flows, is connected to the injection port provided at the compression chamber of the compressor 10. Therefore, even if the extension pipes 5 are long, the degree of subcooling of a liquid refrigerant may be applied to the refrigerant flowing into the indoor units 2, and the discharge temperature of the compressor 10 may be reliably controlled not to exceed the upper limit, under the condition that the discharge temperature of the compressor 10 rises.

[Heating Operation Mode]

Figure 5:
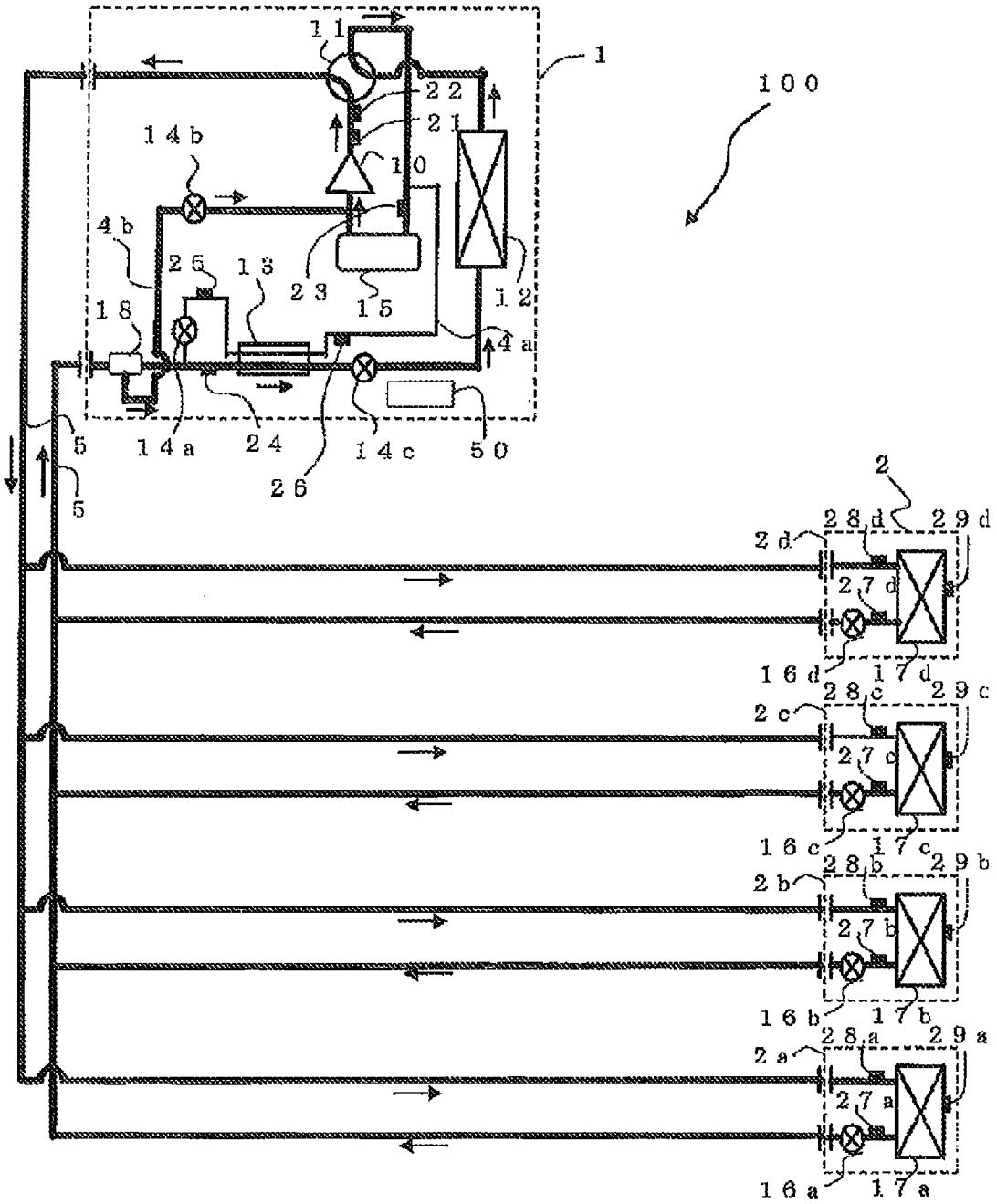
FIG. 5 is a circuit configuration diagram at the time of a heating operation by the air-conditioning apparatus according to Embodiment 1 of the present invention.

FIG. 5 is a diagram illustrating the flow of refrigerant in the refrigerant circuit in the heating operation mode of the air-conditioning apparatus 100. In FIG. 5, the heating operation mode will be explained by way of example of the case where a heating energy load is generated in all the use-side heat exchangers 17. In FIG. 5, pipes indicated by thick lines represent pipes through which refrigerant flows, and the direction in which refrigerant flows is indicated by solid-line arrows.

In the heating operation mode illustrated in FIG. 5, in the outdoor unit 1, the controller 50 instructs the refrigerant flow switching device 11 to perform switching to a flow passage through which a refrigerant which has been discharged from the compressor 10 flows out of the outdoor unit 1 and flows into the indoor units 2 without passing through the heat-source-side heat exchanger 12. Then, the compressor 10 compresses a low-temperature, low-pressure refrigerant and discharges a high-temperature, high-pressure gas refrigerant. The high-temperature, high-pressure gas refrigerant which has been discharged from the compressor 10 passes through the refrigerant flow switching device 11 and flows out of the outdoor unit 1. The high-temperature, high-pressure gas refrigerant which has flowed out of the outdoor unit 1 flows through the extension pipes 5 and flows into the indoor units 2 (2*a* to 2*d*). The high-temperature, high-pressure gas refrigerant which has flowed into the indoor units 2 (2*a* to 2*d*) flows into the use-side heat exchangers 17 (17*a* to 17*d*) and condenses and liquefies into a high-temperature, high-pressure liquid refrigerant while transferring heat to the air circulating around the use-side heat exchangers 17 (17*a* to 17*d*). The liquid refrigerant which has flowed out of the use-side heat exchangers 17 (17*a* to 17*d*) is expanded at the expansion devices 16 (16*a* to 16*d*) into a first-medium-pressure two-phase refrigerant and flows out of the indoor units 2 (2*a* to 2*d*). The first-medium-pressure two-phase refrigerant which has flowed out of the indoor units 2 flows through the extension pipes 5 and flows into the outdoor unit 1 again.

At this time, the opening degree (opening port area) of the expansion devices 16*a* to 16*d* is controlled such that the temperature difference (degree of subcooling) between the temperature detected at use-side heat exchanger intermediate refrigerant temperature detection devices 29 and the temperature detected at the use-side heat exchanger liquid refrigerant temperature detection devices 27 becomes closer to a target value.

The first-medium-pressure two-phase refrigerant which has flowed into the outdoor unit 1 passes through the liquid separator 18 and the first flow passage of the subcooling heat exchanger 13. Then, at the time of passing through the expansion device 14*c*, the refrigerant is expanded into a low-temperature, low-pressure two-phase refrigerant, and flows into the heat-source-side heat exchanger 12. The low-temperature, low-pressure two-phase refrigerant which has flowed into the heat-source-side heat exchanger 12 receives heat from the air circulating around the heat-source-side heat exchanger 12, evaporates into a low-temperature, low-pressure gas refrigerant, passes through the refrigerant flow switching device 11 and the accumulator 15, and is sucked into the compressor 10 again.

In the heating operation mode, there is no need to subcool the refrigerant at the subcooling heat exchanger 13, unlike the cooling operation mode. Therefore, in order to prevent a refrigerant from flowing in the first bypass pipe 4*a*, the opening degree of the expansion device 14*a* is set to be fully closed or small enough for a refrigerant not to flow in the expansion device 14*a*.

The basic operation of a refrigerant in the heating operation mode has been described above. In the case where, refrigerant, such as, for example, R32, which makes the discharge temperature of the compressor 10 higher than R410A, is used, in order to prevent degradation of refrigerating machine oil, burnout of the compressor, and the like, the discharge temperature needs to be lowered. For example, even if the refrigerant is caused to flow toward the inlet side (upstream side) of the accumulator 15, most of the refrigerant is stored in the accumulator 15, and only part of the refrigerant flows into the compressor 10. Thus, after separating part of the liquid refrigerant from the first-medium-pressure two-phase refrigerant which has flowed into the liquid separator 18 by the operation of the liquid separator 18 and decompressing the separated liquid refrigerant into a two-phase refrigerant at second medium pressure, which is lower than the first medium pressure, the refrigerant is caused to flow into the compression chamber of the compressor 10 through the second bypass pipe 4*b* and the injection port provided at the compression chamber of the compressor 10. By causing a refrigerant with a low quality containing a large amount of liquid refrigerant to flow directly into the compression chamber, the temperature of the discharge refrigerant of the compressor 10 can be lowered, and a safe usage can be achieved.

The flow rate of the refrigerant passing through the second bypass pipe 4*b* is adjusted by the opening degree (opening port area) of the expansion device 14*b*. By increasing the opening degree (opening port area) of the expansion device 14*b* to increase the flow rate of the refrigerant flowing through the second bypass pipe 4*b*, the discharge temperature of the compressor 10 is lowered. Conversely, by decreasing the opening degree (opening port area) of the expansion device 14*b* to decrease the flow rate of the refrigerant flowing through the second bypass pipe 4*b*, the discharge temperature of the compressor 10 is increased. By adjusting the opening degree (opening port area) of the expansion device 14*b* as described above, the discharge temperature, which is a value detected at the discharge refrigerant temperature detection device 21, can be made closer to a target value.

Furthermore, by adjusting the opening degree of the expansion device 14*c*, the pressure of the refrigerant between the expansion device 16 and the expansion device 14*a* can be controlled to a first medium pressure. The pressure of the refrigerant inside the liquid separator 18, which is arranged between the expansion device 16 and the expansion device 14*a*, can be maintained at the first medium pressure. Therefore, the pressure difference between before and after passing through the second bypass pipe 4*b* can be secured, and a refrigerant can be injected into the compression chamber of the compressor 10 without fail. The opening degree (opening port area) of the expansion device 14*c* is adjusted such that the pressure obtained by converting the temperature detected at the liquid refrigerant temperature detection device 24 into a saturation pressure becomes closer to a target value. With this adjustment, the apparatus can be configured with low cost. However, the present invention is not limited to this. For example, the opening degree of the expansion device 14*c* may be adjusted by detecting the pressure by using a pressure sensor.

Furthermore, in the heating operation mode, in the case where heating is performed when the outside air temperature is low, such as when the temperature around the heat-source-side heat exchanger 12 is low, or the like, injection needs to be performed into the compression chamber of the compressor 10 via the second bypass pipe 4*b*.

Figure 6:
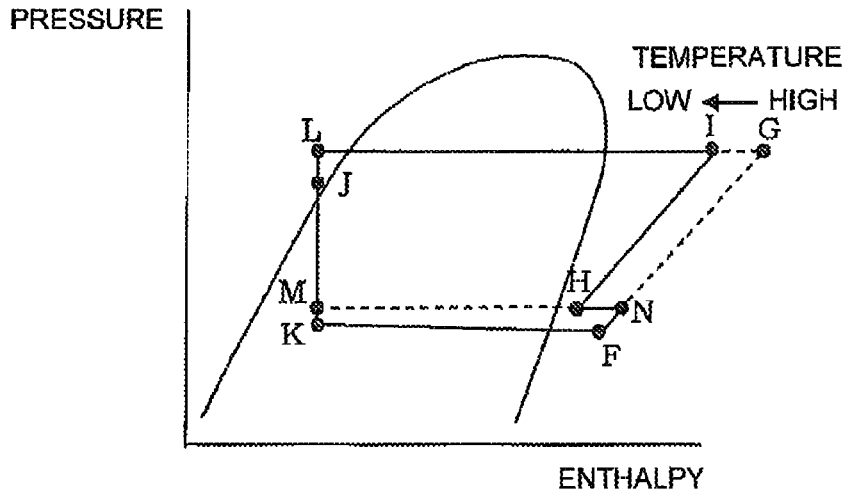
FIG. 6 is a p-h diagram (pressure-enthalpy diagram) at the time of a heating operation by the air-conditioning apparatus according to Embodiment 1 of the present invention.

FIG. 6 is a p-h diagram (pressure-enthalpy diagram) at the time of a heating operation by the air-conditioning apparatus according to Embodiment 1 of the present invention. An injection operation will be described in detail with reference to FIG. 6. In the heating operation mode, the refrigerant which has been compressed at and discharged from the compressor 10 (point I of FIG. 6) flows out of the outdoor unit 1 via the refrigerant flow switching device 11, and flows into the indoor units 2 via the extension pipes 5. Then, after being condensed at the use-side heat exchangers 17 in the indoor units 2 (point L of FIG. 6), the refrigerant passes through the expansion devices 16, is decompressed (point J of FIG. 6), and returns to the outdoor unit 1 via the extension pipes 5. Then, the refrigerant passes through the liquid separator 18 and the first flow passage of the subcooling heat exchanger 13, and flows to the expansion device 14*c*. By adjusting the opening degree of the expansion device 14*c*, the pressure of the refrigerant flowing between the expansion device 16 and the expansion device 14*c* is controlled to a first medium pressure (point J of FIG. 6). Regarding the first-medium-pressure refrigerant flowing between the expansion device 16 and the expansion device 14*c*, part of the liquid refrigerant is split at the liquid separator 18. Part of the split liquid refrigerant flows through the second bypass pipe 4*b*, is decompressed by the expansion device 14*b* into a second-medium-pressure two-phase refrigerant (point M of FIG. 6), and is injected into the compression chamber through the injection port provided at the compression chamber of the compressor 10. Meanwhile, a remaining first-medium-pressure refrigerant, which is other than the part of the liquid refrigerant separated at the liquid separator 18, is decompressed at the expansion device 14*c* into a low-pressure two-phase refrigerant (point K of FIG. 6). Then, after evaporating at the heat-source-side heat exchanger 12, the refrigerant flows into the accumulator 15 via the refrigerant flow switching device 11 (point F of FIG. 6). The refrigerant which has flowed out of the accumulator 15 is sucked into the compressor 10 and compressed into a second medium pressure (point N of FIG. 6). Then, the refrigerant merges with the refrigerant which has been injected through the second bypass pipe 4*b*, and is cooled (point H of FIG. 6).

As described above, the low-temperature, low-pressure refrigerant which has been sucked into the compressor 10 is heated by the air-tight container and the motor of the compressor 10 (point F of FIG. 6). After the temperature of the refrigerant rises, the refrigerant is sucked into the compression chamber. The gas refrigerant which has been sucked into the compression chamber is compressed into a second medium pressure (point N of FIG. 6). In the case where the refrigerant is injected into the compression chamber of the compressor 10, the temperature of the refrigerant becomes lower (point H of FIG. 6) than the case where the refrigerant which is merged with the injected two-phase refrigerant and cooled and which is not subjected to injection (point N of FIG. 6). Inside the compression chamber, compression continues to be performed, and the refrigerant is turned into a high-pressure gas refrigerant. Therefore, the discharge temperature of the compressor 10 in the case where injection is performed becomes lower (point I of FIG. 6) than the discharge temperature of the compressor 10 in the case where injection is not performed (point G of FIG. 6). For example, even in the case where a refrigerant, such as R32, which makes the discharge temperature of the compressor 10 higher than R410A, is used, or the like, by performing injection, the discharge temperature of the compressor 10 can be lowered, and a safe usage can be achieved. Furthermore, a high reliability can be achieved.

It is desirable that the expansion device 14*c* is, for example, an electronic expansion valve or the like whose opening port area is variable. With the use of an electronic expansion valve, the first medium pressure, which is the pressure of the refrigerant on the upstream side of the expansion device 14*c*, may be adjusted to a desired pressure, and the discharge temperature can thus be finely controlled. However, the expansion device 14*c* is not limited to the above. For example, opening and closing valves, such as small-sized solenoid valves, may be combined together so that the opening degree can be selectively controlled in multiple stages. Furthermore, a configuration in which subcooling may be performed in accordance with the pressure loss of a refrigerant by using a capillary tube may be provided. Although the controllability is slightly degraded, the degree of subcooling can be made closer to a target. In order to prevent the discharge temperature of the compressor 10 (temperature detected at the discharge refrigerant temperature detection device 21) from being excessively increased, the opening degree of the expansion device 14*b* is adjusted so that the flow rate of the refrigerant may be adjusted.

At the time of execution of the heating operation mode, there is no need to cause refrigerant to flow to the use-side heat exchanger 17 that has no thermal load (heating load) (including thermo-off). However, in the heating operation mode, when the opening degree of the expansion device 16 corresponding to the use-side heat exchanger 17 having no heating load is set to be fully closed or small enough for a refrigerant not to flow in the expansion device 16, the refrigerant inside the use-side heat exchanger 17 of the stopped indoor unit 2 (hereinafter, referred to as a stopped indoor unit 2) is cooled by the surrounding air, condensed, and stored inside the use-side heat exchanger 17. Thus, the entire refrigerant circuit may result in a shortage of refrigerant. Accordingly, in Embodiment 1, during a heating operation, the opening degree (opening port area) of the expansion device 16 corresponding to the use-side heat exchanger 17 without thermal load is set to be large, for example, fully opened, so that a refrigerant can pass through the expansion device 16. Therefore, accumulation of the refrigerant can be prevented.

Figure 7:
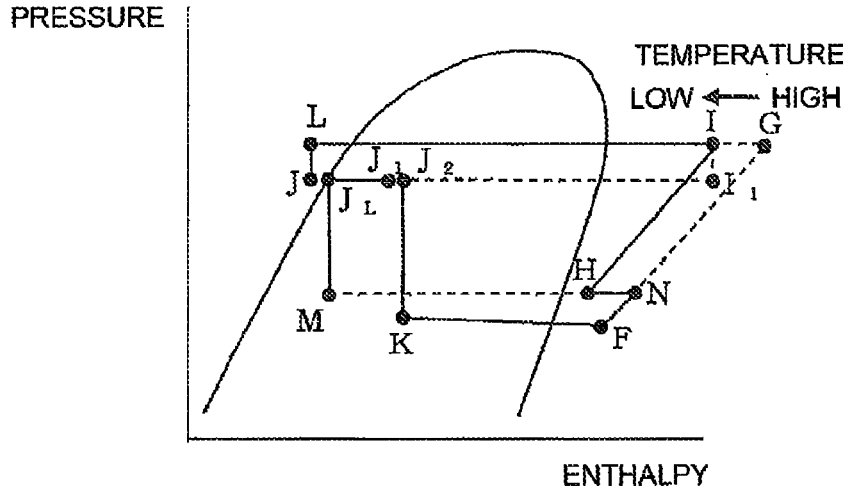
FIG. 7 is another p-h diagram (pressure-enthalpy diagram) at the time of a heating operation by the air-conditioning apparatus according to Embodiment 1 of the present invention.

FIG. 7 is a p-h diagram (pressure-enthalpy diagram) in the case where there is a stopped indoor unit 2 when the air-conditioning apparatus according to Embodiment 1 of the present invention is performing a heating operation. As described above, in the stopped indoor unit 2, the opening degree of the expansion device 16 is set to be large. Therefore, there is a flow of a refrigerant passing though the stopped indoor unit 2. However, the refrigerant is not condensed at the use-side heat exchanger 17 without thermal load. Therefore, at the expansion device 16 of the stopped indoor unit 2, a high-temperature, high-pressure gas refrigerant is decompressed. In the heating operation mode, the refrigerant which has been compressed at and discharged from the compressor 10 (point I of FIG. 7) flows out of the outdoor unit 1 via the refrigerant flow switching device 11, and flows into the indoor units 2 via the extension pipes 5. The refrigerant which has flowed to the use-side heat exchanger 17 with a thermal load is condensed (point L of FIG. 7), passes through the expansion device 16, and turns into a first medium pressure (point J of FIG. 7). Then, the refrigerant flows out of the indoor unit 2, and passes through the extension pipe 5. Meanwhile, the refrigerant which has flowed to the use-side heat exchanger 17 without heating load passes through the use-side heat exchanger 17 and the expansion device 16 while maintaining the gas-refrigerant state without being condensed, and turns into a first medium pressure (point $I_1$ of FIG. 7). Then, the refrigerant flows out of the stopped indoor unit 2, and passes through the extension pipe 5. At any position of the extension pipe 5, the first-medium-pressure liquid refrigerant and the first-medium-pressure gas refrigerant are mixed together into a first-medium-pressure two-phase refrigerant (point $J_1$ of FIG. 7), and flows into the liquid separator 18 of the outdoor unit 1. Regarding the first-medium-pressure two-phase refrigerant which has flowed into the liquid separator 18, part of the liquid refrigerant is split by the operation of the liquid separator 18 (point $J_L$ of FIG. 7). The split liquid refrigerant flows through the second bypass pipe 4*b*, is decompressed by the expansion device 14*b* into a second-medium-pressure two-phase refrigerant (point M of FIG. 7), and flows into the compression chamber through the injection port of the compressor 10. Meanwhile, the first-medium-pressure two-phase refrigerant which has passed through the liquid separator 18 and whose quality has been slightly increased (point $J_2$ of FIG. 7) is further decompressed at the expansion device 14*c* into a low-pressure two-phase refrigerant (point K of FIG. 7). Then, after evaporating at the heat-source-side heat exchanger 12, the refrigerant flows into the accumulator 15 via the refrigerant flow switching device 11 (point F of FIG. 7). The refrigerant which has flowed out of the accumulator 15 is sucked into the compressor 10 and is compressed into a second medium pressure (point N of FIG. 7). The refrigerant merges with the refrigerant which has been injected through the second bypass pipe 4*b*, and is cooled (point H of FIG. 7).

The flow rate of the refrigerant flowing in an expansion device varies according to the density of the refrigerant, even at the same opening degree (opening port area). Two-phase refrigerant contains low-density gas refrigerant and a high-density liquid refrigerant. Therefore, for example, when refrigerant flowing into the expansion device 14*b* or the like is changed from a liquid refrigerant into a two-phase refrigerant, the density of the refrigerant is greatly changed, and the opening degree (opening port area) that defines an appropriate flow rate for lowering the discharge temperature of the compressor 10 by a certain degree is greatly changed. If no measures are taken, the opening degree of the expansion device 14*b* needs to be greatly changed in accordance with the operation or non-operation of the indoor unit 2, and stable control cannot be performed. However, by providing the liquid separator 18, even when an indoor unit 2 not operating exists, only liquid refrigerant can be separated at the liquid separator 18. Therefore, only a liquid refrigerant can be caused to flow into the expansion device 14*b*, and stable control can be performed.

The controller 50 controls the opening degree (opening port area) of the expansion device 14*b* such that the discharge temperature becomes closer to a target value. It is preferable that the target value for the discharge temperature is lower than a limit value of the discharge temperature and as high as possible so that the indoor unit 2 demonstrates a higher capacity (heating capacity or cooling capacity). Thus, for example, when the limit value of the discharge temperature of the compressor 10 is 120 degrees Centigrade, in order to prevent the discharge temperature from exceeding the limit value, the frequency of the compressor 10 is reduced to slow down when the discharge temperature exceeds 110 degrees Centigrade. Thus, in the case where the discharge temperature of the compressor 10 is lowered by performing injection, the target value for the discharge temperature may be set to a temperature (for example, 105 degrees Centigrade) between 100 degrees Centigrade, which is slightly lower than 110 degrees Centigrade at which the frequency of the compressor 10 is reduced, and 110 degrees Centigrade. For example, in the case where the frequency of the compressor 10 is not reduced at 110 degrees Centigrade, the target value for the discharge temperature to be reduced by performing injection may be set to a temperature (for example, 115 degrees Centigrade) between 100 degrees Centigrade and 120 degrees Centigrade.

Furthermore, when it is determined that the discharge temperature exceeds a certain value (for example, 110 degrees Centigrade), the expansion device 14*b* may control the opening degree thereof to open by a certain opening degree, such as, by 10 pulses. Furthermore, instead of the certain value, a range may be set as the target temperature, and the discharge temperature may be controlled to fall within a target temperature range (for example, between 100 degrees Centigrade and 110 degrees Centigrade). Furthermore, the degree of discharge superheat of the compressor 10 may be obtained based on the temperature detected at the discharge refrigerant temperature detection device 21 and the pressure detected at the high-pressure detection device 22, and the opening degree of the expansion device 14*b* may be controlled such that the degree of discharge superheat reaches a target value (for example, 40 degrees Centigrade). Furthermore, the degree of discharge superheat may be controlled to fall within a target range (for example, between 20 degrees Centigrade and 40 degrees Centigrade).

Embodiment 2

Although not particularly explained in Embodiment 1 described above, a four-way valve is generally used as the refrigerant flow switching device 11. However, the present invention is not limited to this. A configuration in which flow switching similar to that performed by a four-way valve is performed by using multiple two-way flow switching valves, three-way flow switching valves, or the like may be provided.

Furthermore, although the case where four indoor units 2 are connected has been described above as an example, conditions similar to those in Embodiment 1 can be obtained, irrespective of the number of connected indoor units 2. However, if only one indoor unit 2 is connected, since no stopped indoor unit exits during a heating operation, there is no need to install the liquid separator 18.

Furthermore, for example, when an opening and closing valve is provided on the refrigerant inflow side of each of the indoor units 2 during a heating operation, a refrigerant may be prevented from flowing into the stopped indoor unit 2, and accumulation can be avoided. Since no refrigerant flow is generated in the stopped indoor unit 2, there is no need to provide the liquid separator 18.

In Embodiment 1 described above, the details of the configuration of the liquid separator 18 have not been particularly explained. For example, the liquid separator 18 only needs to have a configuration in which one inlet-side flow passage and two outlet-side flow passages are provided, a liquid refrigerant is separated from a refrigerant which has flowed in from the inlet-side flow passage, and the separated liquid refrigerant is caused to flow out through one of the outlet-side flow passages to the second bypass pipe 4*b*. Furthermore, even in the case where some amount of gas refrigerant is contained in the refrigerant flowing out to the second bypass pipe 4*b*, if the degree of mixture of the gas refrigerant is small enough not to greatly affect the control of an expansion device, the separation efficiency of the liquid refrigerant at the liquid separator 18 needs not necessarily be 100%. Furthermore, the liquid separator 18 may be provided upstream the subcooling heat exchanger 13 with respect to the flow of the refrigerant at the time a heating operation. During the heating operation, when the liquid separator 18 is provided upstream the subcooling heat exchanger 13, the refrigerant inside the liquid separator 18 is not affected by the pressure loss in the first flow passage of the subcooling heat exchanger 13. Therefore, the accuracy in the measurement of the first medium pressure obtained by detection by the liquid refrigerant temperature detection device 24 can be improved, and the accuracy in the control of the discharge temperature can thus be improved.

Furthermore, even in the case where plural outdoor units 1 are connected in parallel to the extension pipes 5, similar conditions are achieved.

Furthermore, although the case where a low-pressure shell-type compressor is used as the compressor 10 has been explained as an example, similar effects can also be achieved, for example, when a compressor of a high-pressure shell type is used.

In Embodiment 1 described above, a refrigerant is not defined. However, effects of the present invention are particularly enhanced when a refrigerant which raises the discharge temperature, such as R32, is used. Apart from R32, a refrigerant mixture (zeotropic refrigerant mixture) of R32 and HFO1234yf, which is a tetrafluoropropene-system refrigerant which has a small global warming potential and which is expressed by a chemical formula $CF_3\ CF{=}CH_2$, HFO1234ze, or the like may be used. For example, when R32 is used as a refrigerant, the discharge temperature rises by about 20 degrees Centigrade, compared to the case where R410A is used in the same operation state. Therefore, there is a need to lower the discharge temperature, and injection in the present invention has a large effect. Furthermore, in the case of a refrigerant mixture of R32 and HFO1234yf, when the mass ratio of R32 is 62% (62 wt %) or more, the discharge temperature rises by 3 degrees Centigrade or more compared to the case where an R410A refrigerant is used. Therefore, injection in the present invention has a large effect in lowering the discharge temperature. Furthermore, in the case of a refrigerant mixture of R32 and HFO1234ze, when the mass ratio of R32 is 43% (43 wt %) or more, the discharge temperature rises by 3 degrees Centigrade or more compared to the case where an R410A refrigerant is used. Therefore, injection in the present invention has a large effect in lowering the discharge temperature. Furthermore, the types of refrigerant in a refrigerant mixture are not limited to the above. Even with a refrigerant mixture containing a small amount of another refrigerant component, the influence on the discharge temperature is not large, and similar effects can be achieved. Furthermore, for example, a refrigerant mixture of R32, HFO1234yf, and a small amount of another refrigerant, or the like may also be used. For any refrigerant which makes the discharge temperature higher than R410A, the discharge temperature needs to be lowered, and similar effects can be achieved.

Furthermore, in general, an blower device for promoting condensation or evaporation of a refrigerant by sending air is often attached to the heat-source-side heat exchanger 12 and the use-side heat exchangers 17*a* to 17*d*. However, the present invention is not limited to this. For example, devices, such as panel heaters utilizing radiation, may be used as the use-side heat exchangers 17*a* to 17*d*. Furthermore, a water-cooled heat exchanger which performs heat exchange by a fluid, such as water or antifreeze, may be used as the heat-source-side heat exchanger 12. Any type of heat exchanger may be used as long as heat transfer or heat reception of a refrigerant can be performed.

Furthermore, although a direct-expansion air-conditioning apparatus which causes a refrigerant to circulate by connecting the outdoor unit 1 with the indoor units 2 by pipes has been explained as an example, the present invention is not limited to this. For example, a relay unit is provided between the outdoor unit 1 and the indoor units 2. The present invention is also applied to an air-conditioning apparatus which performs air conditioning by causing a refrigerant to circulate between the outdoor unit and the relay unit, causing a heat medium, such as water or brine, to circulate between the relay unit and the indoor units, and performing heat exchange between the refrigerant and the heat medium at the relay unit, and similar effects can be achieved.

Embodiment 3

Figure 8:
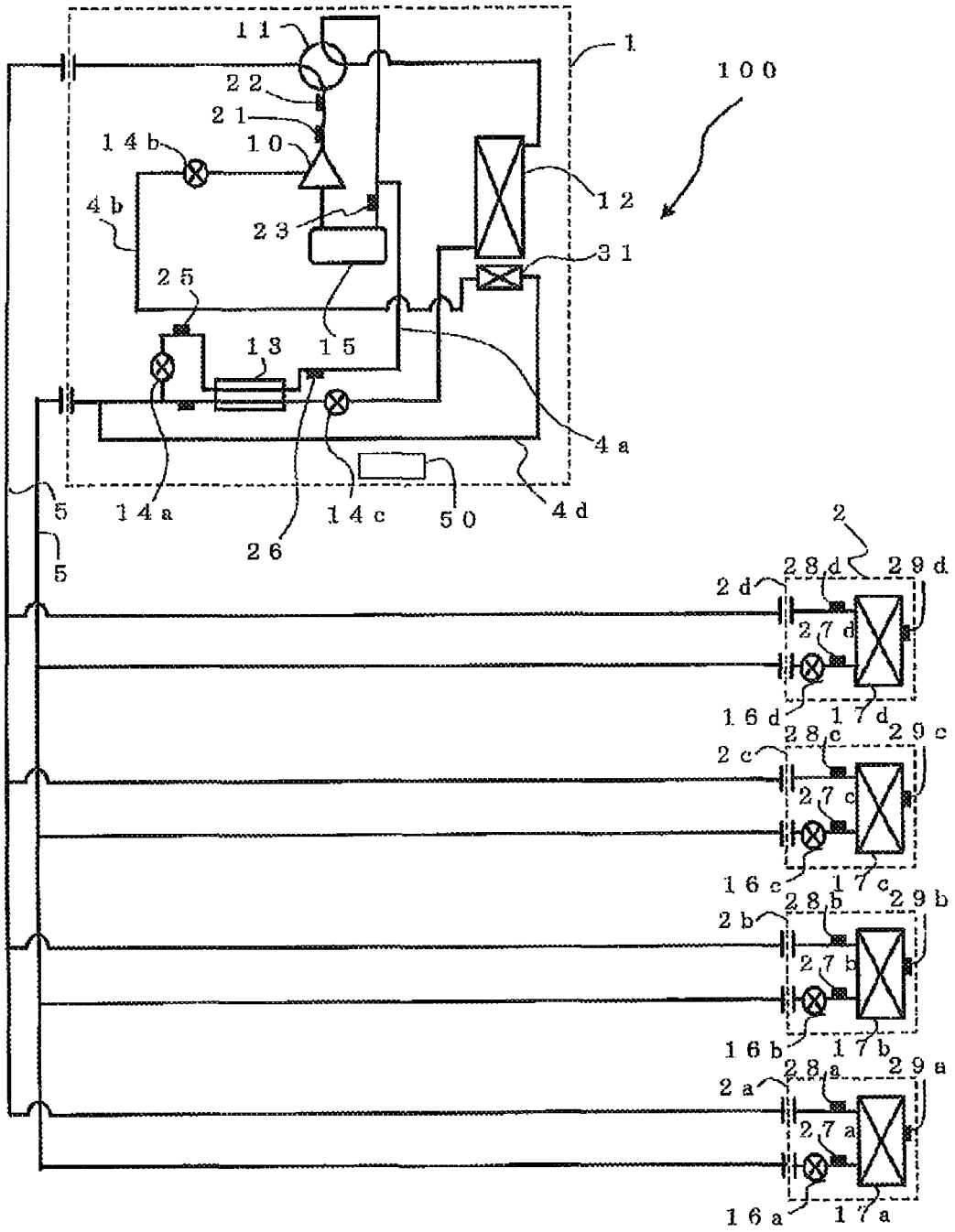
FIG. 8 is a circuit configuration diagram of an air-conditioning apparatus according to Embodiment 3 of the present invention.

FIG. 8 is a circuit configuration diagram of an air-conditioning apparatus according to Embodiment 3 of the present invention. A configuration and the like of the air-conditioning apparatus according to Embodiment 3 of the present invention will be explained with reference to FIG. 8 and the like. In Embodiment 3, explanation of the same contents as those in Embodiment 1 will be omitted. In Embodiment 3, a refrigerant is caused to branch out from a pipe on the post stream side of the subcooling heat exchanger 13 at the time of a cooling operation (without providing the liquid separator 18, which is provided in Embodiment 1). Then, the refrigerant is caused to flow into the second bypass pipe 4*b* and the expansion device 14*b* via a fourth bypass pipe 4*d* (a part of the second bypass pipe 4*b* that serves as a pipe on the inflow side of an auxiliary heat exchanger 31) and the auxiliary heat exchanger 31, and flow into the compressor 10 through the injection port. The auxiliary heat exchanger 31 in Embodiment 3 is arranged at a position which is in the vicinity of the heat-source-side heat exchanger 12 and from which surrounding air may be supplied also to the auxiliary heat exchanger 31 by the operation of the blower device which sends and supplies air to the heat-source-side heat exchanger 12. For example, the auxiliary heat exchanger 31 may be arranged below the heat-source-side heat exchanger 12, so that a fin is shared with the heat-source-side heat exchanger 12, that is, the heat-source-side heat exchanger 12 and the auxiliary heat exchanger 31 may be formed in an integrated manner. With a configuration in which the path for a refrigerant of the heat-source-side heat exchanger 12 and the path for a refrigerant of the auxiliary heat exchanger 31 are separated so that the flows of refrigerant are not mixed together, two heat exchangers may be configured at low cost. In addition, with the same blower device, surrounding air may be sent to both the heat-source-side heat exchanger 12 and the auxiliary heat exchanger 31.

[Cooling Operation Mode]

Figure 9:
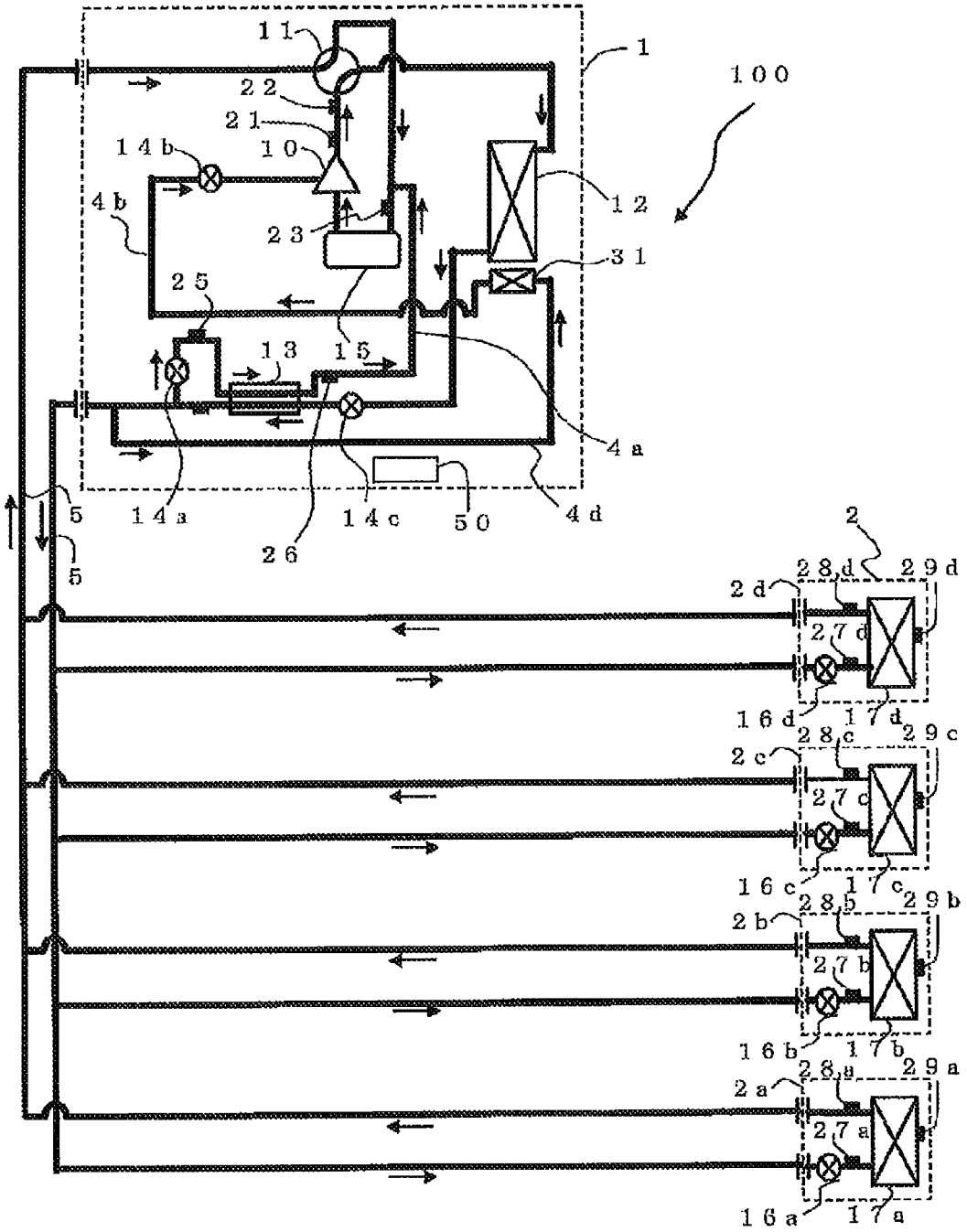
FIG. 9 is a circuit configuration diagram at the time of a cooling operation by the air-conditioning apparatus according to Embodiment 3 of the present invention.

FIG. 9 is a diagram illustrating the flow of a refrigerant in the refrigerant circuit in the cooling operation mode of the air-conditioning apparatus 100 according to Embodiment 3. The cooling operation mode will be explained with reference to FIG. 9 by way of example of the case where a cooling energy load is generated in all the use-side heat exchangers 17. In FIG. 9, pipes indicated by thick lines represent pipes through which a refrigerant flows, and the direction in which a refrigerant flows is indicated by solid-line arrows.

In the cooling operation mode illustrated in FIG. 9, in the outdoor unit 1, the controller 50 instructs the refrigerant flow switching device 11 to perform switching to a flow passage through which a refrigerant which has been discharged from the compressor 10 flows into the heat-source-side heat exchanger 12. The high-temperature, high-pressure gas refrigerant which has been discharged from the compressor 10 flows through the refrigerant flow switching device 11 into the heat-source-side heat exchanger 12. The refrigerant which has flowed into the heat-source-side heat exchanger 12 condenses and liquefies while transferring heat to the outdoor air at the heat-source-side heat exchanger 12, and turns into a high-pressure liquid refrigerant. Then, passing through the fully-opened expansion device 14*c* and the first flow passage of the subcooling heat exchanger 13, the liquid refrigerant is split and flows into two flow passages. A refrigerant which has flowed through one of the flow passages flows out of the outdoor unit 1. A refrigerant which has flowed through the other one of the flow passages flows into the first bypass pipe 4*a*.

The high-temperature, high-pressure liquid refrigerant which has flowed into the first bypass pipe 4*a* is decompressed at the expansion device 14*a* into a low-temperature, low-pressure two-phase refrigerant. The two-phase refrigerant passes through the second flow passage of the subcooling heat exchanger 13, and merges with the refrigerant flowing from the indoor unit 2 side in a flow passage on the upstream side of the accumulator 15. At this time, at the subcooling heat exchanger 13, heat exchange is performed between the high-temperature, high-pressure liquid refrigerant which has flowed through the first flow passage and the low-temperature, low-pressure two-phase refrigerant which has flowed through the second flow passage. The refrigerant which has flowed through the first flow passage is cooled by the refrigerant which has flowed through the second flow passage. The refrigerant which has flowed through the second flow passage is heated by the refrigerant which has flowed through the first flow passage.

Meanwhile, the high-temperature, high-pressure liquid refrigerant which has flowed out of the outdoor unit 1 flows through the extension pipes 5 and flows into the indoor units 2 (2*a* to 2*d*). The refrigerant which has flowed into the indoor units 2 (2*a* to 2*d*) passes through the expansion devices 16 (16*a* to 16*d*) and is decompressed. At the use-side heat exchangers 17 (17*a* to 17*d*), the decompressed refrigerant evaporates by heat exchange with air in an air-conditioned space, and turns into a low-temperature, low-pressure gas refrigerant. The gas refrigerant flows out of the indoor units 2, flows through the extension pipes 5, and flows into the outdoor unit 1 again. Then, the refrigerant which has flowed into the outdoor unit 1 passes through the refrigerant flow switching device 11, merges with a refrigerant which has flowed through the first bypass pipe 4*a* and caused to flow toward the upstream side of the accumulator 15, and then flows into the accumulator 15. Then, the refrigerant is sucked into the compressor 10 again.

In the case where, a refrigerant, such as, for example, R32, which may make the discharge temperature of the compressor 10 higher than R410A, is used, in order to prevent degradation of refrigerating machine oil, burnout of the compressor 10, and the like, the discharge temperature needs to be lowered. In Embodiment 3, part of a liquid refrigerant which has flowed out of the subcooling heat exchanger 13 is caused to split and flow into the auxiliary heat exchanger 31 via the fourth bypass pipe 4*d*. Furthermore, the refrigerant is injected into the compression chamber of the compressor 10 via the second bypass pipe 4*b* and the expansion device 14*b* to lower the discharge temperature of the compressor 10. The auxiliary heat exchanger 31 is installed at a position, together with the heat-source-side heat exchanger 12, through which air from an blower device passes. Therefore, at the auxiliary heat exchanger 31, the high-temperature, high-pressure liquid refrigerant is cooled by heat exchange with air having a lower temperature, increases the degree of subcooling thereof, and flows out of the auxiliary heat exchanger 31. With a configuration including the auxiliary heat exchanger 31, even if the refrigerant which has passed through the subcooling heat exchanger 13 does not fully enter a liquid state and is in a two-phase state due to a reason, such as a shortage of the amount of refrigerant in the refrigerant circuit, a refrigerant may be turned into the fully liquid state by heat exchange at the auxiliary heat exchanger 31. Therefore, the refrigerant in the two-phase state can be prevented from flowing into the expansion device 14*b*, noise can be prevented from being generated at the expansion device 14*b*, and control of the discharge temperature of the compressor 10 by the expansion device 14*b* can be prevented from being unstable. The control of the flow rate of the refrigerant passing through the second bypass pipe 4*b* by the expansion device 14*b* is similar to that explained in Embodiment 1.

Although the case where a branch port at which the refrigerant is caused to branch off to the auxiliary heat exchanger 31 is arranged at a position which is on the post stream side of the subcooling heat exchanger 13 in the cooling operation mode has been explained, there is no problem if the branch port is installed at a position closer to the heat-source-side heat exchanger 12 than the subcooling heat exchanger 13.

Furthermore, the auxiliary heat exchanger 31 is used to subcool a refrigerant for injection. The flow rate of a refrigerant to be injected may be smaller than the flow rate of a refrigerant flowing in the main refrigerant circuit. Therefore, the heat transfer area of the auxiliary heat exchanger 31 is not necessarily so large. Thus, in Embodiment 3, the heat transfer area of the auxiliary heat exchanger 31 is configured to be smaller than the heat transfer area of the heat-source-side heat exchanger 12.

[Heating Operation Mode]

Figure 10:
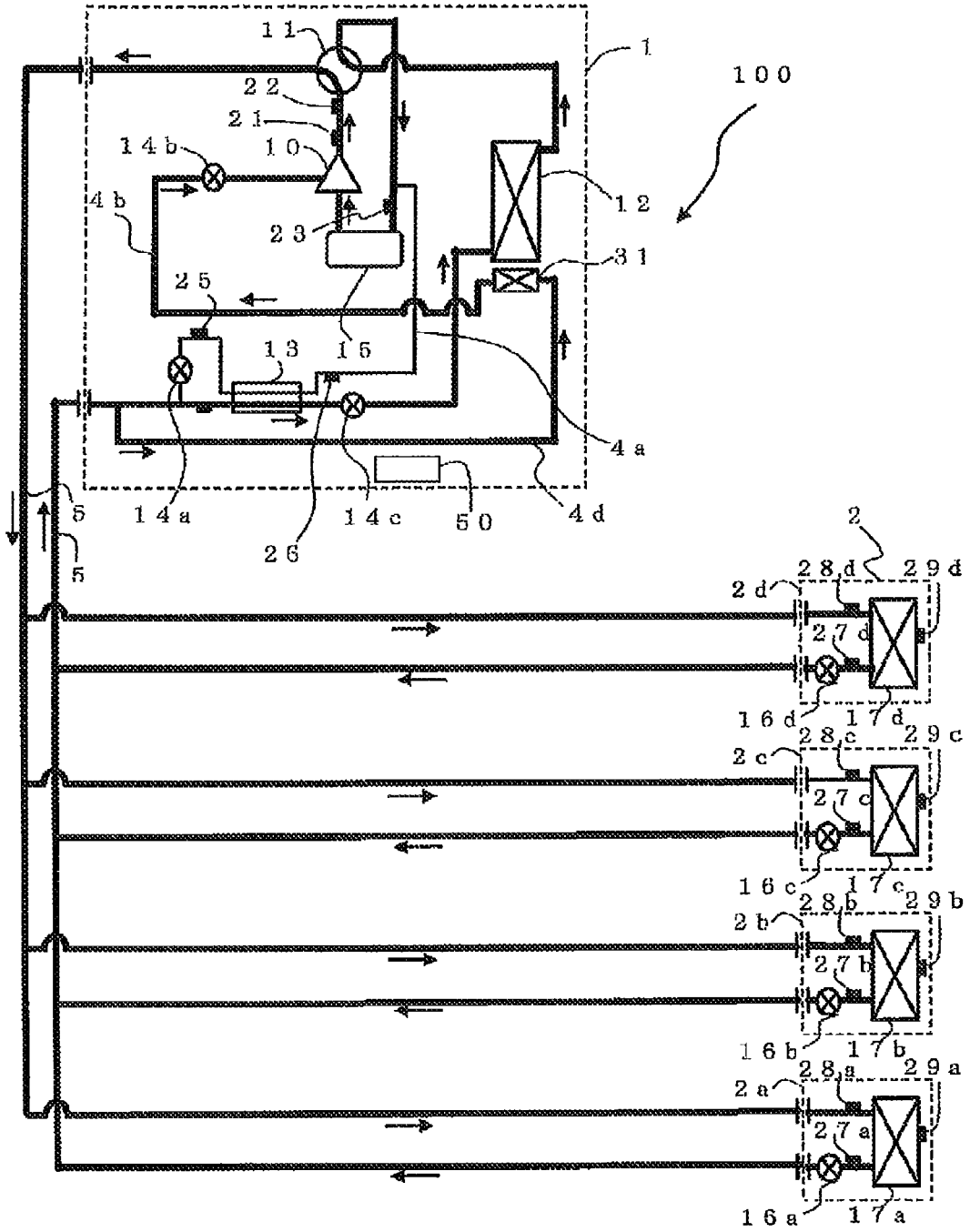
FIG. 10 is a circuit configuration diagram at the time of a heating operation by the air-conditioning apparatus according to Embodiment 3 of the present invention.

FIG. 10 is a diagram illustrating the flow of a refrigerant in the refrigerant circuit in the heating operation mode of the air-conditioning apparatus 100 according to Embodiment 3. The heating operation mode will be explained with reference to FIG. 10 by way of example of the case where a heating energy load is generated in all the use-side heat exchangers 17. In FIG. 10, pipes indicated by thick lines represent pipes through which a refrigerant flows, and the direction in which a refrigerant flows is indicated by solid-line arrows.

In the heating operation mode illustrated in FIG. 10, in the outdoor unit 1, the controller 50 instructs the refrigerant flow switching device 11 to perform switching to a flow passage through which a refrigerant which has been discharged from the compressor 10 flows out of the outdoor unit 1 and flows into the indoor units 2 without passing through the heat-source-side heat exchanger 12. The high-temperature, high-pressure gas refrigerant which has been discharged from the compressor 10 flows through the refrigerant flow switching device 11 and flows out of the outdoor unit 1. The refrigerant which has flowed out of the outdoor unit 1 flows through the extension pipes 5 and flows into the indoor units 2 (2*a* to 2*d*). The refrigerant which has flowed into the indoor units 2 is condensed by heat exchange at the use-side heat exchangers 17 (17*a* to 17*d*). The condensed refrigerant is further expanded at the expansion devices 16 (16*a* to 16*d*) into a medium-temperature, medium-pressure two-phase refrigerant, and flows out of the indoor units 2. The refrigerant which has flowed out of the indoor units 2 flows through the extension pipes 5 and flows into the outdoor unit 1 again.

The medium-pressure two-phase refrigerant which has flowed into the outdoor unit 1 passes through the first flow passage of the subcooling heat exchanger 13 and the expansion device 14*c*, and is expanded into a low-temperature, low-pressure two-phase refrigerant. The two-phase refrigerant flows into the heat-source-side heat exchanger 12, receives heat from the air flowing around the heat-source-side heat exchanger 12, and evaporates into a low-temperature, low-pressure gas refrigerant. The gas refrigerant passes through the refrigerant flow switching device 11 and the accumulator 15, and is sucked into the compressor 10 again. At this time, in the heating operation mode, since there is no need to subcool the refrigerant at the subcooling heat exchanger 13, the opening degree of the expansion device 14*a* is set to be fully closed or small enough for a refrigerant not to flow in the expansion device 14*a*. Thus, no refrigerant flows in the first bypass pipe 4*a*.

In the case where, a refrigerant, such as, for example, R32, which may make the discharge temperature of the compressor 10 higher than R410A, is used, in order to prevent degradation of refrigerating machine oil and burnout of the compressor, the discharge temperature needs to be lowered. Furthermore, part of the medium-pressure two-phase refrigerant which has passed through the extension pipes 5 and flowed into the outdoor unit 1 is caused to split, flow into the auxiliary heat exchanger 31 via the fourth bypass pipe 4*d*, and is injected into the compression chamber of the compressor 10 via the second bypass pipe 4*b* and the expansion device 14*b* to lower the discharge temperature of the compressor 10. The auxiliary heat exchanger 31 is installed at a position where surrounding air circulates through both the heat-source-side heat exchanger 12 and the auxiliary heat exchanger 31 due to the operation of the blower device attached to the heat-source-side heat exchanger 12. Therefore, the two-phase refrigerant in the medium pressure state is cooled by heat exchange with air having a lower temperature, condenses and liquefies into a medium-pressure liquid refrigerant, and flows out of the auxiliary heat exchanger 31. With the above configuration, the medium-pressure two-phase refrigerant may be turned into a refrigerant in the liquid state by the operation of the auxiliary heat exchanger 31, the refrigerant in the two-phase state can be prevented from flowing into the expansion device 14*b*, noise can be prevented from being generated at the expansion device 14*b*, and control of the discharge temperature of the compressor 10 by the expansion device 14*b* can be prevented from being unstable. The control of the flow rate of the refrigerant passing through the second bypass pipe 4*b* by the expansion device 14*b* is similar to that explained in Embodiment 1, and therefore the explanation of the control will be omitted.

In FIG. 8 and the like, the heat-source-side heat exchanger 12 is illustrated as if it is an air-cooled heat exchanger which performs heat exchange between a refrigerant and surrounding air. However, the heat-source-side heat exchanger 12 is not necessarily an air-cooled heat exchanger. A water-cooled heat exchanger using a plate-type heat exchanger which performs heat exchange between a refrigerant and water or brine, or the like may be used as the heat-source-side heat exchanger 12. In the case where a water-cooled heat exchanger is used as the heat-source-side heat exchanger 12, the auxiliary heat exchanger 31 is a heat exchanger which is independent of the heat-source-side heat exchanger 12. In addition, an air-cooled heat exchanger which exchanges heat between a refrigerant which flows through the fourth bypass pipe 4*d* and surrounding air may be newly provided. Furthermore, another water-cooled heat exchanger, such as a plate-type heat exchanger, which causes water or brine circulating through the heat-source-side heat exchanger 12 to branch off and which exchanges heat between the water or brine and the refrigerant which flows through the fourth bypass pipe 4*d*, may be installed. Similar effects may also be achieved when any of the above heat exchangers is installed.

Furthermore, the auxiliary heat exchanger 31 is used to subcool a refrigerant for injection, and the injection flow rate is smaller than the main flow rate. Therefore, the heat transfer area is not necessarily so large, and the auxiliary heat exchanger 31 is configured to have a heat transfer area smaller than the heat transfer area of the heat-source-side heat exchanger 12. For example, it is desirable that the heat transfer area of the auxiliary heat exchanger 31 is set to 1/20 or less the heat transfer area of the heat-source-side heat exchanger 12. In this case, the performance deterioration caused by the reduction in the heat transfer area of the heat-source-side heat exchanger 12 is small, such as 1.5% or less. Furthermore, when the heat transfer area of the auxiliary heat exchanger 31 is set to 1/60 or more the heat transfer area of the heat-source-side heat exchanger 12, even if a refrigerant in the two-phase state flows into the auxiliary heat exchanger 31, such a heat transfer area is sufficient for an injection refrigerant to be subcooled. However, no particularly large problem is caused by a slightly larger or slightly smaller heat transfer area of the auxiliary heat exchanger 31. Furthermore, in the case where a water-cooled heat exchanger which exchanges heat between water or brine and a refrigerant is used as the heat-source-side heat exchanger 12, the auxiliary heat exchanger 31 may be formed independently of the heat-source-side heat exchanger 12, as described above. It is desirable that in substantially the same operation state as the case where no refrigerant is circulated through the second bypass pipe 4*b*, when a refrigerant is circulated through the second bypass pipe 4*b* and the discharge temperature of the compressor 10 is lowered by 10 degrees Centigrade, the size of the auxiliary heat exchanger 31 is set such that the cooling capacity of the refrigerant at the auxiliary heat exchanger 31 is, for example, 1/10 or less the rated heating capacity or rated cooling capacity of the air-conditioning apparatus 100. In this case, the auxiliary heat exchanger 31 may be provided at low cost. Furthermore, similarly, in the state where the discharge temperature of the compressor 10 is lowered by 10 degrees Centigrade, when the cooling capacity of the refrigerant at the auxiliary heat exchanger 31 is set to 1/60 or more the rated heating capacity of rated cooling capacity of the air-conditioning apparatus 100, even if a refrigerant in the two-phase state flows into the auxiliary heat exchanger 31, an injection refrigerant is sufficiently subcooled. However, no particularly large problem is caused by a slightly larger or slightly smaller cooling capacity of the auxiliary heat exchanger 31.

Furthermore, since a liquid refrigerant is caused to branch off to the auxiliary heat exchanger 31 as much as possible, regarding the branch port through which a refrigerant is caused to branch off to the auxiliary heat exchanger 31, it is desirable that a pipe is led downward from a refrigerant pipe for a main flow and the refrigerant is caused to branch off.

Figure 11:
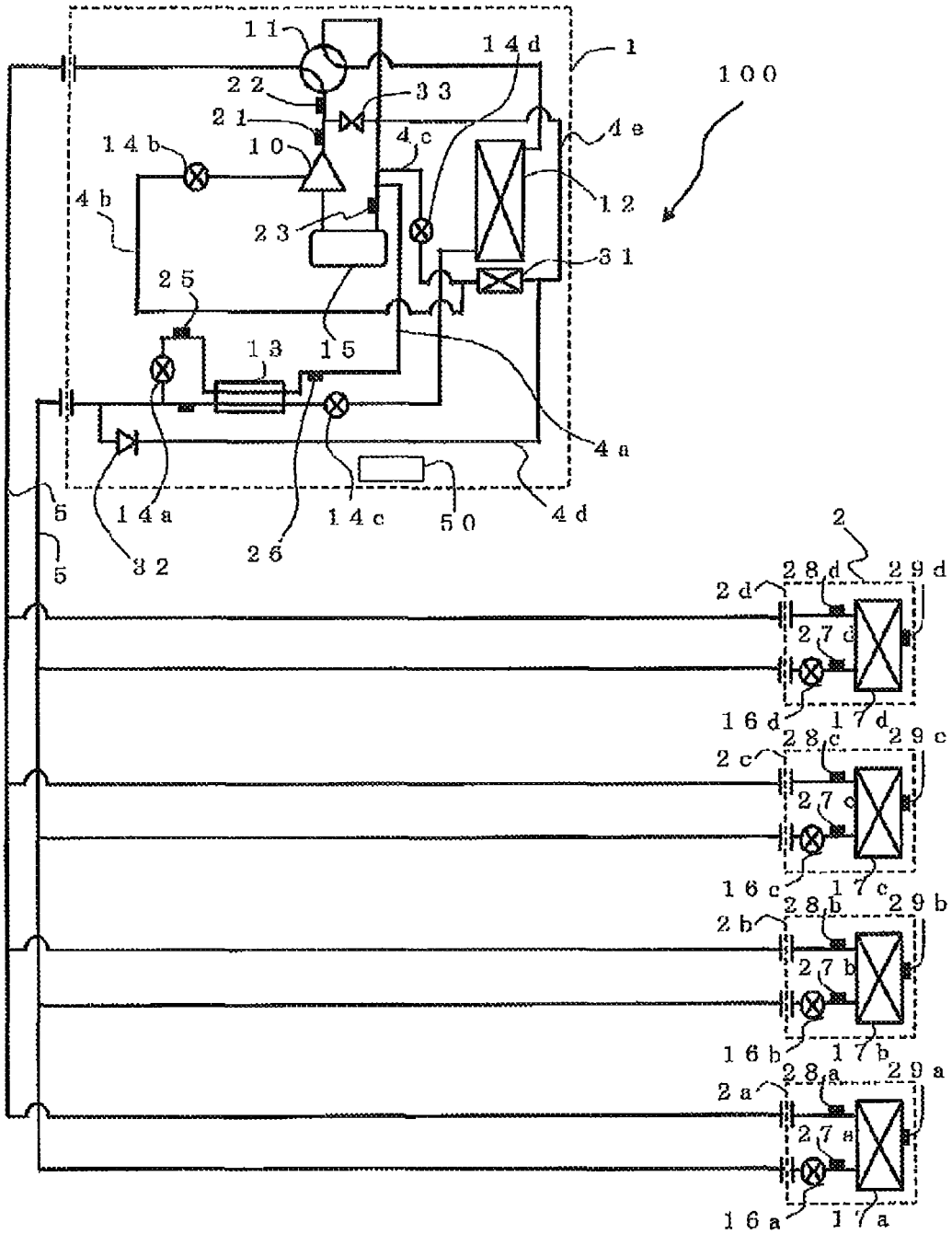
FIG. 11 is another circuit configuration diagram of the air-conditioning apparatus according to Embodiment 3 of the present invention.

FIG. 11 is another circuit configuration diagram of the air-conditioning apparatus 100 according to Embodiment 3 of the present invention. A configuration in which a pipe and the like serving as an ice formation countermeasure circuit is further added to the air-conditioning apparatus 100 of FIG. 8. The ice formation countermeasure circuit further includes a fifth bypass pipe 4*e* and an opening and closing device 33, and a third bypass pipe 4*c* and an expansion device 14*d*. The ice formation countermeasure circuit is a circuit configured by connecting a pipe on the discharge side of the compressor 10 with a pipe on the suction side of the compressor 10 (suction side of the accumulator 15) via the auxiliary heat exchanger 31.

The fifth bypass pipe 4*e*, which serves as a hot gas bypass pipe, is a pipe for allowing connection between the pipe on the discharge side of the compressor 10 and the fourth bypass pipe 4*d* (pipe on the refrigerant inflow side of the auxiliary heat exchanger 31). The opening and closing device 33 controls whether or not to cause a refrigerant to pass through the fifth bypass pipe 4*e*. Furthermore, the third bypass pipe 4*c*, which serves as an ice formation countermeasure bypass pipe, is a pipe for allowing connection between the second bypass pipe 4*b* (pipe on the refrigerant outflow side of the auxiliary heat exchanger 31) and the pipe on the refrigerant inflow side of the accumulator 15. The expansion device 14*d* controls the flow rate and pressure of the refrigerant passing through the third bypass pipe 4*c*.

For example, although frost is deposited around the heat-source-side heat exchanger 12 during a heating operation, if the amount of deposited frost becomes excessive, the heating capacity on the load side at the time of the heat operation is degraded. Thus, a defrosting operation for thawing the frost is performed. However, after completion of the defrosting operation, water obtained by the frost thawing may be attached below the heat-source-side heat exchanger 12. If the next heating operation is performed with water attached on the heat-source-side heat exchanger 12, the water is cooled and ice is generated. Therefore, the heating capacity on the load side is reduced during the heating operation. Furthermore, ice has a high density and therefore is not easily melted even if it is heated. Thus, even if the next defrosting operation is completed, ice has not been melted completely, and ice formation may occur. Accordingly, in order to prevent formation of ice or the like, the auxiliary heat exchanger 31 is arranged below the heat-source-side heat exchanger 12, and the heat-source-side heat exchanger 12 is arranged below the auxiliary heat exchanger 31, so that a fin is shared, and the heat-source-side heat exchanger 12 and the auxiliary heat exchanger 31 are formed in an integrated manner. With such a configuration, during a defrosting operation, water generated by thawing the frost around the heat-source-side heat exchanger 12 descends through the fin due to the gravitational force, and is attached around the auxiliary heat exchanger 31, which is located below the heat-source-side heat exchanger 12.

Figure 12:
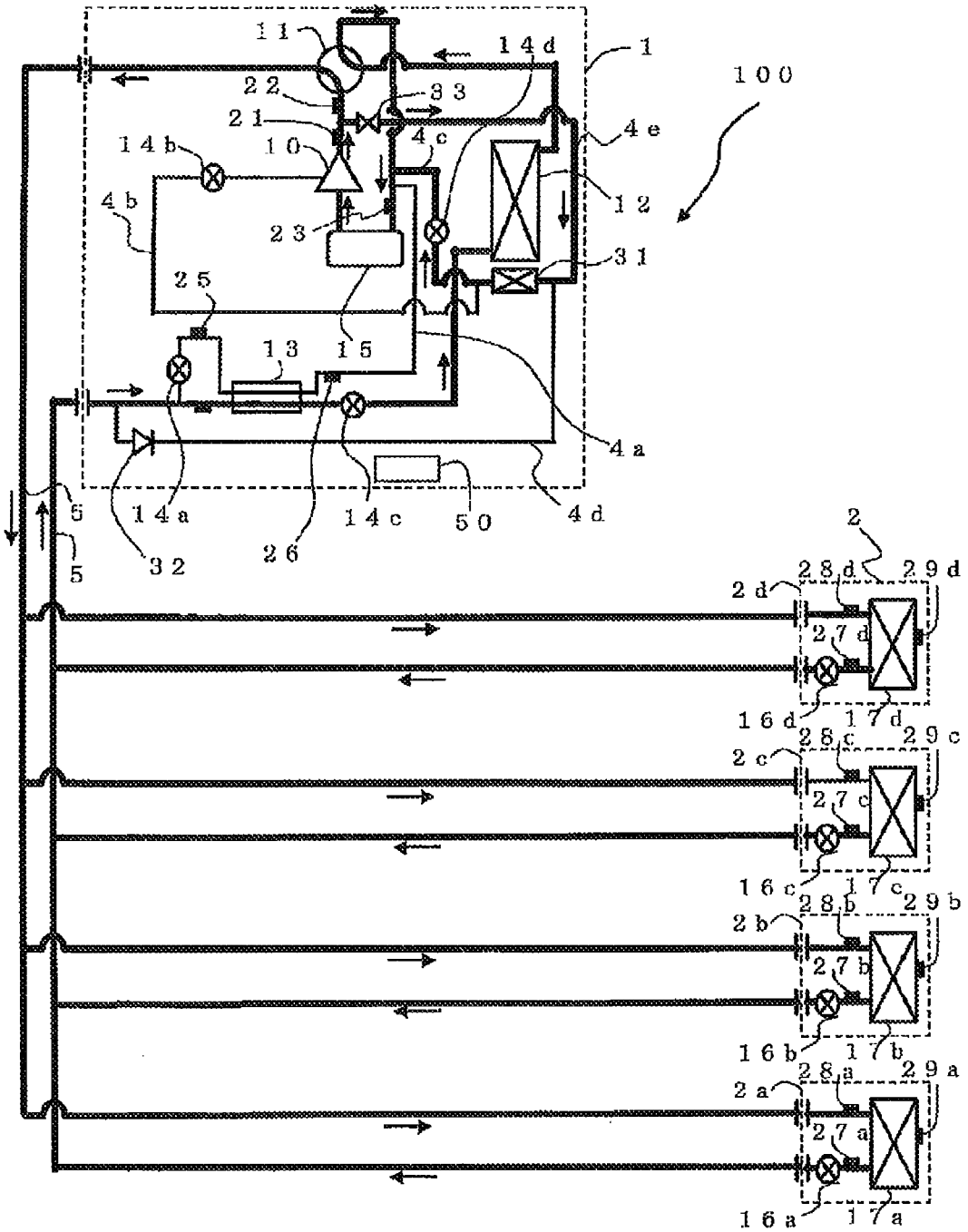
FIG. 12 is a circuit configuration diagram at the time of an ice formation countermeasure operation by the air-conditioning apparatus according to Embodiment 3 of the present invention.

FIG. 12 is a circuit configuration diagram at the time of an ice formation countermeasure operation by the air-conditioning apparatus according to Embodiment 3 of the present invention. The air-conditioning apparatus 100 of FIG. 11 including the ice formation countermeasure circuit performs the ice formation countermeasure operation illustrated in FIG. 12 after completing the defrosting operation, and then moves onto a normal heating operation.

During the ice formation countermeasure operation, part of a high-temperature, high-pressure gas refrigerant which has been discharged from the compressor 10 is split. The split part of the high-temperature, high-pressure gas refrigerant passes through the fifth bypass pipe 4*e* via the opening and closing device 33, and flows into the auxiliary heat exchanger 31. Then, the high-temperature, high-pressure gas refrigerant causes the water attached around the auxiliary heat exchanger 31 to evaporate. Thus, during the heating operation, a situation in which the heating operation continues to be performed with water attached around the heat-source-side heat exchanger 12 and the auxiliary heat exchanger 31 can be prevented, and generation of ice formation can be prevented. The opening degree of the expansion device 14*d* is set to be fully opened during the ice formation countermeasure operation and set to be fully closed or small enough for a refrigerant not to flow in the expansion device 14*d* during the other state. Instead of the expansion device 14*d*, an opening and closing device (second opening and closing device) whose inner aperture is smaller than a pipe may be used.

In the case where the above ice formation countermeasure circuit and the discharge temperature suppression circuit for the compressor 10 by injection via the auxiliary heat exchanger 31 coexist, the same auxiliary heat exchanger 31 may be used for both the purposes of countermeasure against ice formation and suppression of discharge temperature. By sharing the auxiliary heat exchanger 31, the total volume of the heat exchangers in the outdoor unit 1 may be reduced, and an inexpensive configuration can be achieved. At this time, by providing a backflow prevention device 32 at the fourth bypass pipe 4*d*, a high-temperature, high-pressure gas refrigerant may be prevented from flowing backward from the fifth bypass pipe 4*e* to the fourth bypass pipe 4*d* during the ice formation countermeasure operation.

During the ice formation countermeasure operation, that is, during the period in which a high-temperature, high-pressure gas refrigerant is circulated through the auxiliary heat exchanger 31 via the fifth bypass pipe 4*e*, by setting the opening degree of the expansion device 14*b* to be fully closed or small enough for a refrigerant not to flow in the expansion device 14*b*, even if the discharge temperature of the compressor 10 excessively rises, a flow of a refrigerant through the second bypass pipe 4*b* does not occur. However, during the ice formation countermeasure operation, even though injection into the compressor 10 is not performed, the controller 50 performs protection control, such as reduction of the frequency of the compressor 10, in order not to excessively raise the discharge temperature of the compressor 10. Therefore, the system does not become abnormal, and no problem occurs.

Then, the ice formation countermeasure operation, that is, the operation for causing a refrigerant to flow to the fifth bypass pipe 4*e*, is completed after a predetermined time has passed. After that, the opening and closing device 33 is closed, the opening degree of the expansion device 14*d* is set to be fully closed or small enough for a refrigerant not to flow in the expansion device 14*d*, and a normal heating operation is performed.

During a normal heating operation, as described above, if the discharge temperature of the compressor 10 excessively rises, the opening degree of the expansion device 14*b* is controlled in accordance with the discharge temperature of the compressor 10. Then, injection into the compression chamber of the compressor 10 via the fourth bypass pipe 4*d* and the second bypass pipe 4*b* is performed, and the discharge temperature of the compressor 10 is controlled to an appropriate value.

In FIG. 8 and the like, the backflow prevention device 32 is illustrated as if it is a check valve. However, any type of device may be used as the backflow prevention device 32 as long as a backward flow of a refrigerant can be prevented. For example, an opening and closing device, an expansion device having a fully closing function, or the like may be used as the backflow prevention device 32. Furthermore, the opening and closing device 33 only needs to perform opening and closing of a flow passage, and an expansion device having a fully closing function may be used as the opening and closing device 33.

REFERENCE SIGNS LIST

1: heat source unit (outdoor unit), 2, 2*a*, 2*b*, 2*c*, 2*d*: indoor unit, 4*a*: first bypass pipe, 4*b*: second bypass pipe, 4*c*: third bypass pipe, 4*d*: fourth bypass pipe, 4*e*: fifth bypass pipe 5: extension pipe (refrigerant pipe), 6: outdoor space, 7: indoor space, 8: space, such as a space above a ceiling, different from outdoor space and indoor space, 9: structure, such as building, 10: compressor, 11: refrigerant flow switching device (four-way valve), 12: heat-source-side heat exchanger, 13: subcooling heat exchanger, 14*a*, 14*b*, 14*c*, 14*d*: expansion device, 15: accumulator, 16, 16*a*, 16*b*, 16*c*, 16*d*: expansion device, 17, 17*a*, 17*b*, 17*c*, 17*d*: use-side heat exchanger, 18: liquid separator, 21: discharge refrigerant temperature detection device, 22: high-pressure detection device, 23: low-pressure detection device, 24: liquid refrigerant temperature detection device, 25: subcooling heat exchanger inlet refrigerant temperature detection device, 26: subcooling heat exchanger outlet refrigerant temperature detection device, 27, 27*a*, 27*b*, 27*c*, 27*d*: use-side heat exchanger liquid refrigerant temperature detection device, 28, 28*a*, 28*b*, 28*c*, 28*d*: use-side heat exchanger gas refrigerant temperature detection device, 29, 29*a*, 29*b*, 29*c*, 29*d*: use-side heat exchanger intermediate refrigerant temperature detection device, 31: auxiliary heat exchanger, 32: backflow prevention device, 33: opening and closing device, 50: controller, 100: air-conditioning apparatus

The invention claimed is:

1. An air-conditioning apparatus including a refrigerant circuit formed by connecting, with pipes, a compressor including a compression chamber and an injection port through which refrigerant is introduced into the compression chamber, the compressor being configured to compress refrigerant and discharge the compressed refrigerant, a first heat exchanger that exchanges heat with the refrigerant, a subcooling heat exchanger that includes a first flow passage and a second flow passage and exchanges heat between a portion of the refrigerant flowing in the first flow passage and another portion of the refrigerant flowing in the second flow passage to subcool the portion of refrigerant flowing in the first flow passage, a first expansion device to decompress the refrigerant, a second heat exchanger that exchanges heat with the refrigerant, and an accumulator connected to a suction side of the compressor and configured to store excess refrigerant, so that the refrigerant is circulated through the refrigerant circuit, the air-conditioning apparatus comprising:

a first bypass pipe that connects the second flow passage of the subcooling heat exchanger with a segment of the pipes, the segment being positioned on a refrigerant inflow side of the accumulator;

a second expansion device to adjust a flow rate of the refrigerant flowing in the first bypass pipe;

a second bypass pipe that connects a segment of the pipes with the injection port, the segment being positioned between the first heat exchanger and the second heat exchanger;

a third expansion device to adjust a flow rate of the refrigerant flowing in the second bypass pipe;

an auxiliary heat exchanger arranged at a position which is in a vicinity of the first heat exchanger and is configured to receive, together with the first heat exchanger, air blown by a blower device and to exchange heat with the refrigerant passing through the second bypass pipe on an upstream side of the third expansion device with respect to a direction of refrigerant flow, wherein the auxiliary heat exchanger is arranged below the first heat exchanger;

a hot gas bypass pipe that allows connection between a pipe on a discharge side of the compressor and a pipe on a refrigerant inflow side of the auxiliary heat exchanger via an opening and closing device; and a backflow prevention device that is installed on an upstream side of a part of the second bypass pipe that is connected to the hot gas bypass pipe with respect to the direction of refrigerant flow.

2. The air-conditioning apparatus of claim 1 using a refrigerant that makes the discharge temperature of the compressor higher than that when using R410A as a refrigerant under same conditions and further comprising:

a discharge temperature detector for detecting a discharge temperature of the compressor; and a controller configured to control the flow rate of the refrigerant flowing in the second bypass pipe by adjusting an opening degree of the third expansion device, based on the discharge temperature or a value obtained based on the discharge temperature.

3. The air-conditioning apparatus of claim 2, wherein the controller sets a target value for the discharge temperature to a value between 100 degrees Centigrade and 120 degrees Centigrade, and adjusts the opening degree of the third expansion device based on the target value for the discharge temperature.

4. The air-conditioning apparatus of claim 2, wherein the controller sets the target value for the discharge temperature to a value between 100 degrees Centigrade and 110 degrees Centigrade, and adjusts the opening degree of the third expansion device based on the target value for the discharge temperature.

5. The air-conditioning apparatus of claim 2, wherein the controller adjusts the opening degree of the third expansion device based on the discharge temperature of the compressor or the value obtained based on the discharge temperature, irrespective of an operation mode.

6. The air-conditioning apparatus of claim 1, wherein R32 or a refrigerant mixture of R32 with a mass ratio of 62% or more is used.

7. The air-conditioning apparatus of claim 1, further comprising a refrigerant flow switching device to switch between a state in which the first heat exchanger functions as a condenser and a state in which the first heat exchanger functions as an evaporator, wherein when the first heat exchanger functions as a condenser, an opening degree of the second expansion device is adjusted to control the flow rate of the refrigerant flowing in the first bypass pipe, and when the first heat exchanger functions as an evaporator, the opening degree of the second expansion device is adjusted such that the refrigerant does not flow in the first bypass pipe.

8. The air-conditioning apparatus of claim 1, wherein the compressor, the accumulator, the subcooling heat exchanger, the second expansion device, the third expansion device, the first heat exchanger, the first bypass pipe, and the second bypass pipe are accommodated within an outdoor unit.

9. The air-conditioning apparatus of claim 1, wherein the auxiliary heat exchanger shares a fin with the first heat exchanger and is formed integrally with the first heat exchanger, and wherein a heat transfer area of the auxiliary heat exchanger is smaller than a heat transfer area of the first heat exchanger.

10. The air-conditioning apparatus of claim 1, wherein a heat transfer area of the auxiliary heat exchanger is 1/20 or less a heat transfer area of the first heat exchanger.

11. The air-conditioning apparatus of claim 1, wherein a heat transfer area of the auxiliary heat exchanger falls within a range between 1/60 or more and 1/20 or less a heat transfer area of the first heat exchanger.

12. The air-conditioning apparatus of claim 1, further comprising an ice formation countermeasure bypass pipe that allows connection between a segment of the pipes on a refrigerant outflow side of the auxiliary heat exchanger and a segment of the pipes on the refrigerant inflow side of the accumulator via a fourth expansion device or a second opening and closing device.

13. An air-conditioning apparatus including a refrigerant circuit formed by connecting, with pipes, a compressor including a compression chamber and an injection port through which refrigerant is introduced into the compression chamber, the compressor being configured to compress refrigerant and discharge the compressed refrigerant, a first heat exchanger that exchanges heat with the refrigerant, a subcooling heat exchanger that includes a first flow passage and a second flow passage and exchanges heat between a portion of the refrigerant flowing in the first flow passage and another portion of the refrigerant flowing in the second flow passage to subcool the portion of refrigerant flowing in the first flow passage, a first expansion device to decompress the refrigerant, a second heat exchanger that exchanges heat with the refrigerant, and an accumulator connected to a suction side of the compressor and configured to store excess refrigerant, so that the refrigerant is circulated through the refrigerant circuit, the air-conditioning apparatus comprising:

a first bypass pipe that connects the second flow passage of the subcooling heat exchanger with a segment of the pipes, the segment being positioned on a refrigerant inflow side of the accumulator;

a second expansion device to adjust a flow rate of the refrigerant flowing in the first bypass pipe;

a second bypass pipe that connects a segment of the pipes with the injection port, the segment being positioned between the first heat exchanger and the second heat exchanger;

a third expansion device to adjust a flow rate of the refrigerant flowing in the second bypass pipe; and an auxiliary heat exchanger formed independently of the first heat exchanger, wherein the first heat exchanger is a heat exchanger that exchanges heat between water or brine and a refrigerant, and wherein the auxiliary heat exchanger exchanges heat between the refrigerant and air, water, or brine, the refrigerant passing through the second bypass pipe on an upstream side of the third expansion device with respect to a direction of refrigerant flow.

14. The air-conditioning apparatus of claim 13, wherein a cooling capacity for cooling the refrigerant at the auxiliary heat exchanger is smaller than a rated heating capacity or a rated cooling capacity of the air-conditioning apparatus.

15. The air-conditioning apparatus of claim 13, wherein in substantially a same operation state as a case where no refrigerant is circulated through the second bypass pipe, when the refrigerant is circulated through the second bypass pipe and the discharge temperature of the compressor is lowered by 10 degrees Centigrade, a cooling capacity for cooling the refrigerant at the auxiliary heat exchanger is 1/10 or less a rated heating capacity or rated cooling capacity of the air-conditioning apparatus.

16. The air-conditioning apparatus of claim 13, wherein in substantially a same operation state as a case where no refrigerant is circulated through the second bypass pipe, when the refrigerant is circulated through the second bypass pipe and the discharge temperature of the compressor is lowered by 10 degrees Centigrade, a cooling capacity for cooling the refrigerant at the auxiliary heat exchanger is 1/60 or more and 1/10 or less a rated heating capacity or rated cooling capacity of the air-conditioning apparatus.

* * * * *